US008096674B2

(12) United States Patent
Matthews et al.

(10) Patent No.: US 8,096,674 B2
(45) Date of Patent: Jan. 17, 2012

(54) LIGHTING DEVICE WITH SELECTABLE OUTPUT LEVEL SWITCHING

(75) Inventors: John W. Matthews, Newport Beach, CA (US); Paul Y. Kim, Santa Ana, CA (US); William A. Hunt, Foothill Ranch, CA (US); Luis M. Sanchez, Long Beach, CA (US); Ammar Burayez, Silverado, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 12/775,739

(22) Filed: May 7, 2010

(65) Prior Publication Data

US 2010/0277295 A1 Nov. 4, 2010

Related U.S. Application Data

(63) Continuation-in-part of application No. 11/786,625, filed on Apr. 11, 2007, now Pat. No. 7,722,209, and a continuation of application No. 10/732,883, filed on Dec. 9, 2003, now Pat. No. 7,220,016.

(51) Int. Cl.
*F21L 4/04* (2006.01)

(52) U.S. Cl. ..... 362/206; 362/295; 362/802

(58) Field of Classification Search ..... 362/194–208, 362/295, 802

See application file for complete search history.

(56) References Cited

U.S. PATENT DOCUMENTS

| | | | |
|---|---|---|---|
| 1,214,583 | A | 2/1917 | Persons |
| 4,388,673 | A | 6/1983 | Maglica |
| 4,499,525 | A | 2/1985 | Mallory |
| 4,527,223 | A | 7/1985 | Maglica |
| 4,581,686 | A | 4/1986 | Nelson |
| 4,677,533 | A | 6/1987 | McDermott et al. |
| 4,760,504 | A | 7/1988 | Schaller et al. |
| 4,782,432 | A | 11/1988 | Coffman |
| 4,876,416 | A | 10/1989 | Frantz et al. |
| 4,947,291 | A | 8/1990 | McDermott |
| 5,161,879 | A | 11/1992 | McDermott |
| 5,418,433 | A | 5/1995 | Nilssen |
| 5,498,934 | A | 3/1996 | Nilssen |
| 5,629,105 | A | 5/1997 | Matthews |
| 5,642,932 | A | 7/1997 | Matthews |
| 5,685,637 | A | 11/1997 | Chapman et al. |
| 5,722,755 | A | 3/1998 | Slape |
| 5,790,013 | A | 8/1998 | Hauck |
| 5,821,697 | A | 10/1998 | Weber |
| 6,019,482 | A | 2/2000 | Everett |

(Continued)

OTHER PUBLICATIONS

U.S. Appl. No. 12/887,257, filed Sep. 21, 2010, inventors: Matthews et al., pp. 1-56.

(Continued)

*Primary Examiner* — Jason Moon Han

(74) *Attorney, Agent, or Firm* — Haynes and Boone, LLP

(57) ABSTRACT

Various techniques are provided for implementing a lighting device with selectable output level switching. In one example, a lighting device includes a light source, a controller adapted to provide one or more signals to control the operation of the light source, a power terminal adapted to receive a power source, and a tailcap assembly. The tailcap assembly includes a tailcap, a push button, and a washer disposed in the tailcap. The washer includes at least one arm adapted to be pushed against a surface to selectively connect the controller to the power terminal in response to a manipulation of the tailcap assembly.

41 Claims, 17 Drawing Sheets

U.S. PATENT DOCUMENTS

| | | | |
|---|---|---|---|
| 6,024,471 | A | 2/2000 | McDermott |
| 6,046,572 | A | 4/2000 | Matthews et al. |
| 6,079,847 | A | 6/2000 | Nelson |
| 6,095,661 | A | 8/2000 | Lebens et al. |
| 6,183,105 | B1 | 2/2001 | Parker |
| 6,222,138 | B1 | 4/2001 | Matthews et al. |
| 6,249,089 | B1 | 6/2001 | Bruwer |
| 6,296,367 | B1 | 10/2001 | Parsons et al. |
| 6,305,818 | B1 | 10/2001 | Lebens et al. |
| 6,307,328 | B1 | 10/2001 | Ko et al. |
| 6,386,730 | B1 | 5/2002 | Matthews |
| 6,402,339 | B1 | 6/2002 | Mukogawa et al. |
| 6,616,296 | B1 | 9/2003 | Roux et al. |
| 6,793,366 | B2 | 9/2004 | Chun |
| 6,841,941 | B2 | 1/2005 | Kim et al. |
| 7,116,061 | B2 | 10/2006 | Kim et al. |
| 7,186,002 | B2 | 3/2007 | Matthews et al. |
| 7,220,016 | B2 | 5/2007 | Matthews et al. |
| 7,281,815 | B1 | 10/2007 | Gustafson et al. |
| 7,293,893 | B2 | 11/2007 | Kim |
| RE40,125 | E | 3/2008 | Matthews et al. |
| 7,344,270 | B2 | 3/2008 | Kim |
| 7,527,388 | B2 | 5/2009 | Kim |
| 7,540,625 | B2 | 6/2009 | Matthews et al. |
| 7,566,149 | B2 * | 7/2009 | Koch et al. ..... 362/390 |
| 2003/0106782 | A1 | 6/2003 | Galli |
| 2004/0008510 | A1 | 1/2004 | Mah |
| 2004/0190286 | A1 | 9/2004 | Chapman |
| 2005/0237737 | A1 | 10/2005 | Kim |
| 2007/0195522 | A1 | 8/2007 | Matthews et al. |
| 2007/0247839 | A1 | 10/2007 | Matthews et al. |
| 2008/0272714 | A1 | 11/2008 | Noble et al. |

OTHER PUBLICATIONS

U.S. Appl. No. 12/887,271, filed Sep. 21, 2010, inventors: Matthews et al., pp. 1-52.

* cited by examiner

LIGHTING DEVICE WITH SELECTABLE OUTPUT LEVEL SWITCHING

CROSS-REFERENCE TO RELATED APPLICATIONS

This application is a continuation-in-part application of U.S. patent application Ser. No. 11/786,625 entitled "FLASHLIGHT WITH SELECTABLE OUTPUT LEVEL SWITCHING" filed Apr. 11, 2007, which is a continuation application of U.S. patent application Ser. No. 10/732,883 entitled "FLASHLIGHT WITH SELECTABLE OUTPUT LEVEL SWITCHING" filed Dec. 9, 2003, now issued as U.S. Pat. No. 7,220,016. The entire contents of such applications are hereby incorporated by reference in their entirety.

BACKGROUND

1. Technical Field

The invention generally relates to lighting devices, and more particularly to the switching of lighting devices to operate light sources in various modes.

2. Related Art

Flashlights are conveniently sized battery powered portable light sources, which provide the user with a source of illumination. Said illumination could be white light or light of a specific color, or even light outside the visible range of wavelengths, such as ultraviolet or infrared radiation. The "color" or wavelength of the light will depend on the nature of the light source or light sources used in the flashlight. These would typically be either tungsten lamps, ARC lamps, light emitting diodes (LEDs), lasers, or any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

The principal light source used in flashlights is the tungsten filament lamp, as alternatives suffered inadequate illumination, or excessive battery consumption. Tungsten filament lamps, however, cannot be effectively used as a variable output light source because they must be operated close to their design point (current & voltage) if they are to retain their efficiency in converting electrical energy to light. Generally speaking, the same thing can also be said about ARC lamps. Thus, if one wanted two significantly different light outputs from the same flashlight, this would require the use of two different lamps. Examples of such prior art systems are described in Matthews U.S. Pat. Nos. 5,629,105 and 6,386,730, the former teaching the use of a second lamp protruding through the reflector at a point offset to the side of the main lamp which is located at the focal point of the (parabolic) reflector, and the latter teaching the use of two lamps each with its own reflector, the reflectors merged together in a manner such that the light from each lamp interacts only with its own reflector.

In such existing systems, the switching system consists of mechanical contact arrangement where the physical axial displacement of a switch system element (either by direct finger or thumb pressure or by rotation of a tail cap or head of the flashlight) causes first lamp to be connected to the battery, and additional applied pressure or flashlight element rotation causes the second lamp to be connected to the battery. In some cases the design is such that the first lamp is disconnected when the second lamp is connected to the battery. In other cases, the first lamp remains connected when the second lamp is connected.

In practice, such dual- or multi-source flashlights typically have a pressure switch located on the opposite end of the flashlight from the light source. This switch system, or tail cap, may be rotated through a range of angular positions, each providing a different response to application of a button on the pressure switch. Rotation of the switch on the helical threads connecting it to the flashlight body generates axial movement to move contacts toward or apart from each other. In a first position, the switch contacts are farthest apart, so that full pressure of the button has no effect. This is the "lockout" position. By rotating the switch to the second position, fully pressing the button connects the first lamp to the battery, but not the second (and usually brighter) lamp, which is controlled by more widely spaced contacts that remain locked out. In the third position, which is the position most normally used, moderate pressure on the button first connects the first lamp to the battery; greater pressure, including a "bottoming out" condition then connects the second lamp to the battery. In a fourth rotational position, the first lamp remains on when the button is not pressed and the second lamp is connected in response to additional pressure on the button or to additional rotation of the tail cap. In a fifth rotational position both lamps are connected without the application of any pressure on the button While effective, such dual-source lights have several limitations. First, they require the user either to maintain button pressure throughout illumination, or to rotate a switch between operating modes. This requires either continuous use of one hand, or the occasional use of both hands (to rotate the switch), either of which may be disadvantageous for critical military and law enforcement applications.

When set to certain switch modes existing lights do not enable rapid illumination for emergencies. When in the lockout mode or the second mode noted above, maximum pressure will not illuminate the brighter lamp. Changing modes takes time, and requires two hands, which may be disadvantageous in an emergency.

Existing lights have limited choice of light levels. Many tasks require different illumination levels. The moderate level of illumination provided by the first lamp (LED) for many tasks such as camping and ordinary trail navigation may be much brighter than would be desired for map reading in critical military situations. Other applications may require still different moderate lights levels when the full brightness (and shorter run time) of an incandescent lamp is not suitable. Moreover, there is a substantial range of possibly desired brightness levels between the maximum of the first lamp and the full brightness of the second lamp that are not obtainable.

It should be noted that the term "lamp" is used in its most general meaning, namely that of any light source (which could be a tungsten filament lamp, an LED, or an ARC Lamp) of any wavelength.

SUMMARY

In one embodiment, a flashlight is provided having a lamp, a power source, two switches, and a controller connected to the switches. The first switch controls delivery of power to the lamp, and the second switch selects a dimmed brightness level. The first switch may invoke the dimmed level, or a maximum brightness level. The second switch may be a ring rotatable about the axis the flashlight, and either rotatable through a wide range of positions, with sensor circuitry to detect the absolute position, or having a limited range of rotation, with dimmed level selection provided by a duration of momentary rotation in either direction. The second switch may be positioned outside a leak resistant housing, and may include a magnet detectable by magnetic field sensors within the chamber.

In another embodiment, a lighting device includes a light source, a controller adapted to provide one or more signals to control the operation of the light source, a power terminal adapted to receive a power source, and a tailcap assembly. The tailcap assembly includes a tailcap, a push button, and a washer disposed in the tailcap. The washer includes at least one arm adapted to be pushed against a surface to selectively connect the controller to the power terminal in response to a manipulation of the tailcap assembly.

In another embodiment, a method of operating a lighting device is provided. The lighting device includes a light source, a controller, a power terminal, and a tailcap assembly. The method includes receiving a manipulation of the tailcap assembly. The method also includes selectively connecting the controller to the power terminal in response to the manipulation. The manipulation causes at least one arm of a washer disposed in a tailcap of the tailcap assembly to be pushed against a surface. The method also includes providing one or more signals from the controller to control an operation of the light source in response to the connecting.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly

BRIEF DESCRIPTION OF THE DRAWINGS

Embodiments of the present invention and their advantages are best understood by referring to the description that follows. It should be appreciated that like reference numerals are used to identify like elements illustrated in one or more of the figures.

DETAILED DESCRIPTION

Figure 1:
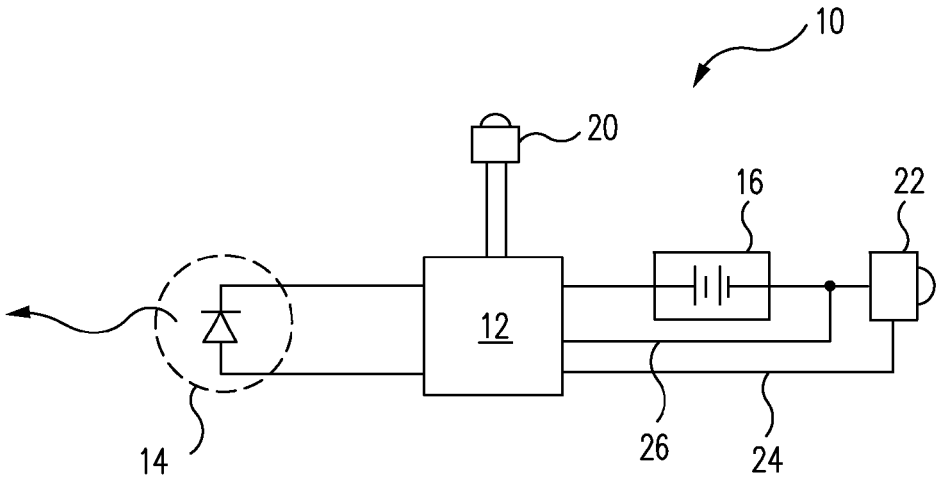
FIG. 1 is a simplified block diagram of a flashlight according to an embodiment of the invention.

FIG. 1 shows a schematic drawing of a flashlight 10 according to an embodiment of the invention. The flashlight includes a micro-processor control circuit 12 that is directly connected to a lamp 14, battery 16, dimmed level control selector 20, and operation switch 22.

In one embodiment, the lamp 14 is a light-emitting diode (LED), and may be a single lamp that operates efficiently over a wide range of input power to produce a wide range of possible light outputs. In alternative embodiments, there may be multiple light sources, either interconnected to provide a single, switchable (and dimmable) array, with all sources operating in the same manner. In other alternatives, there may be separate lamps or independently controllable lamp elements, so that color hue changes may be obtained by operating different color components in different combinations, or so that dimming control may be obtained by illuminating a different number of the components. The lamp may be an alternative light source, such as a tungsten halogen lamp or any other light source, although LED lamps are believed best suited to presently provide efficiency over a wide range of powers and brightness.

The dimmed level selector 20 may be of any type to provide the operator with the means to select a "dim" brightness level at any intermediate level within the range of the lamp's capability. The dimmed level selector is shown as connected directly to the controller 12, although in alternative embodiments the dimmed level selector may communicate with the controller by other means, including magnetic or radio frequency means. For instance, a rotatable ring may have one or more magnets, and the interior of the flashlight may contain a hall effect sensor connected to the controller to sense position or movement of the ring.

The dimmed level selector may have a selector element such as a dial or slider that establishes a dimmed level based on its position. Alternatively, the selector may establish a dimmed level by responding to the operator's duration (or magnitude) of pressure on a switch, such as by gradually rising in brightness in response to actuation until the selector is released. A dimmed level may be set by numerous alternative means, including by operation of the primary control switch 22, such as by its rotational position, by a series or sequence of impulses, or by any other means.

The flashlight 10 includes a conductive housing that is illustrated schematically in FIG. 1 by a ground bus line 24 extending between a battery electrode and switch lead, and the controller 12. As will be discussed below, the housing is a cylindrical tube defining a bore closely receiving one or more cylindrical batteries 16. Thus, it provides a single electrical path from the switch 22 at the rear end of the flashlight, and the controller 12 at the front end.

A second electrical path is provided over the length of the flashlight by the conductive sleeve element 26 shown schematically here, and detailed below. The sleeve is electrically isolated from the housing, and connects at its closed rear end to the rear of the battery 16 and to a contact from the switch 22, and at its open front edge to the lamp 14 and to the controller 12. The sleeve may be replaced in alternative embodiments by a single conductor wire or circuit element such as a flex circuit to provide the same function. Other alternatives include a conductive trace applied to the interior of the housing (isolated therefrom by an insulating film layer) and connected at each end to the appropriate components. The batteries themselves provide a third electrical path.

The second path provided by the sleeve allows the switch to connect with the controller over two paths, so that the controller may detect a resistance presented by the switch to determine its state, as will be discussed below. The second path further ensures that the switch is not serially connected in the loop with the primary current flow from the battery to the lamp, avoiding parasitic losses due to switch resistance.

Figure 2:
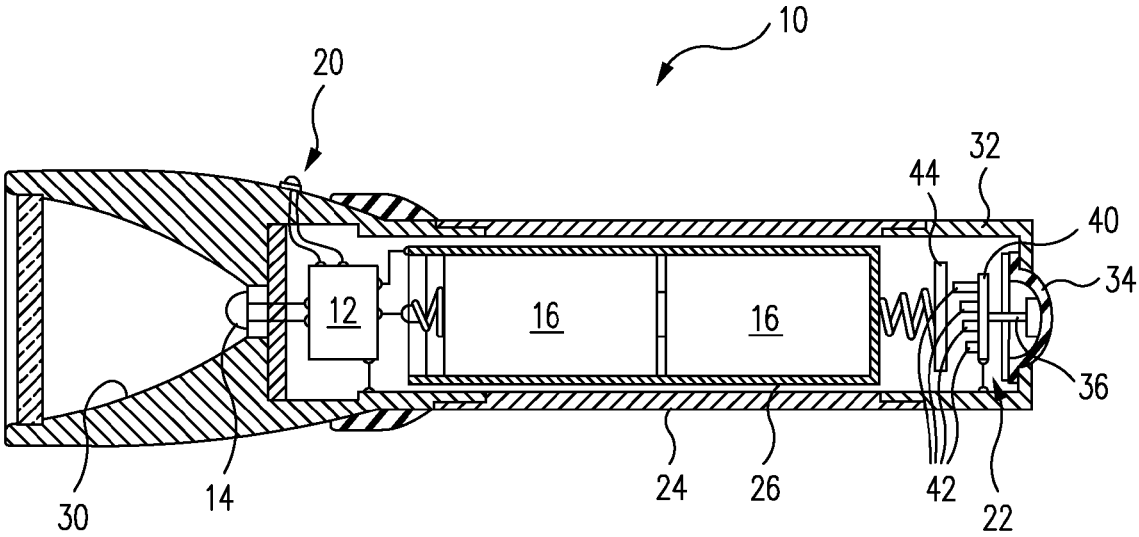
FIG. 2 is a sectional view of the flashlight of FIG. 1.

FIG. 2 shows the physical structure of an embodiment, with a lens 30 forward of the lamp 14. The housing has several essentially cylindrical portions defining a chamber for containing the lens, lamp, controller 12, batteries, and switch 22. The dimmer level control 20 is shown in simplified form, and may take any form including a ring rotatable about the housing. The switch (shown in simplified form) is contained within a tail cap 32 having an elastomeric flexible dome 34 covering a switch actuator 36. The switch has a movable portion 40 having several contacts 42 each connected to the housing ground. The movable portion reciprocates axially with respect to a fixed switch portion 44 connected to the conductive sleeve 26.

Figure 3:
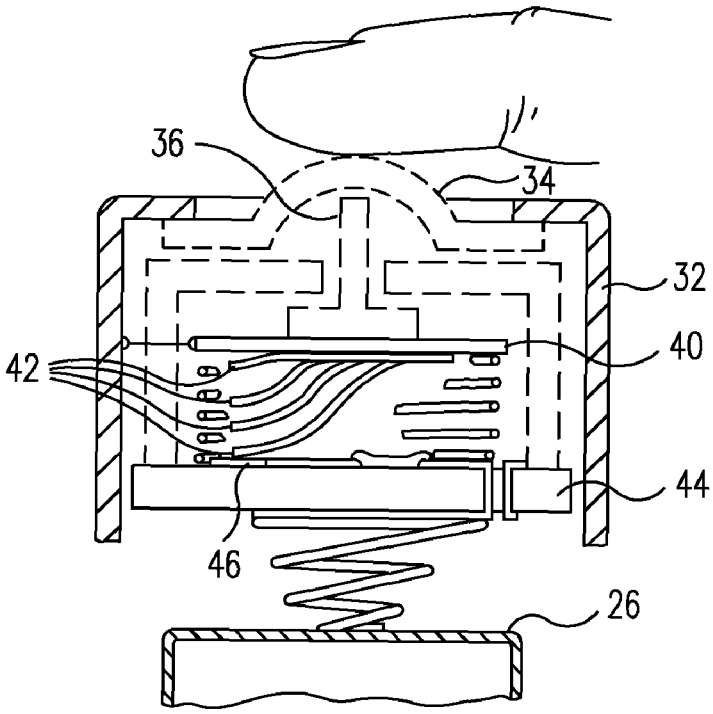
FIG. 3 is an enlarged sectional side view of the switch assembly of the flashlight of FIG. 1.

As shown in FIG. 3, the contacts 42 of the movable portion 40 are leaf springs, each extending a different distance from a base panel that is connected to the housing ground. The switch shown in FIGS. 2 and 3 is simplified for clarity of the principles of its operation. In one embodiment, the actual switch configured like existing such switches that allow a bi-level operation. Such switches have the contacts arranged in arcs or annuluses to allow the switch to function when the tail cap is rotated through a range of positions. One embodiment would have its contacts configured as such, although this would unduly complicate the illustrations, which are shown in schematic form.

Figure 4:
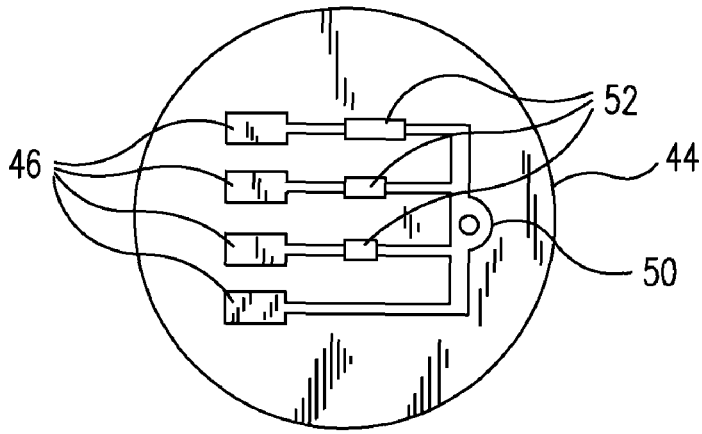
FIG. 4 is an enlarged plan view of a switch assembly component of the flashlight of FIG. 1.

All the leaf spring contacts are connected to each other. As the switch is depressed over its range of axial travel, the contacts contact the fixed element 44 in sequence. As shown in FIG. 4, the fixed element includes an array of pads 46, each positioned to be contacted by a respective end of a leaf spring contact 42. The pads are all connected to a node 50 that connects via a plated through-hole or other means to the opposite side of the element, which thereby connects to the sleeve 26. Each pad 46 connects to the node 50 with a different intervening resistance. Several resistors 52 are provided to intervene between the various pads and the node.

Before the switch button is depressed, the resistance between the fixed portion (and thereby the controller's connection to the sleeve) and the movable portion (and thereby the controller's connection to the housing ground) is infinite. When the button is slightly depressed, a first leaf spring contact makes contact with a pad associated with a resistor. The controller may thus determine by this resistance across these lines that the button has been pressed to an intermediate position. In one embodiment, the controller then operates the lamp at the pre-selected dimmed illumination level.

When the button is further depressed, another leaf spring contacts a pad. In the simplest case, the switch has only two contacts (not the four illustrated), and the second contact would contact a pad having no resistor. This reflects a condition when the switch is fully depressed, and would cause the controller to provide full brightness illumination. In the more complex embodiment illustrated, there are five button states (including the released condition) determinable by the controller, so that various brightness levels or preselected dimmed or hue outputs might be provided based on the switch condition. One embodiment requires at least two different contacts that make contact at different depression amounts of the button, and are connected to at least one resistor to provide a different output resistance depending on whether one, both, or neither are making contact. In the simple case, one extending spring contact may protrude, with the moving element panel 44 making direct contact in the fully actuated position.

By having an electronic controller connected to the switch, additional switching and control capabilities may be provided that are not provided by a conventional switch in line with the power loop. The illumination of the lamp need not correspond to the position of the switch. This enables a "click-on, click-off" switch mode in which a momentary actuation of the switch causes sustained illumination, and a second momentary actuation ceases illumination. This function is provided in the absence of a conventional mechanical switch that switches between open and closed contact positions using springs and ratcheting mechanisms, in the manner of a ball-point pen or other conventional on-off flashlight switches.

By electronic control of switching operations, significant additional capabilities are made available. The controller may detect the duration of pressure on the button, the magnitude of pressure (for embodiments with multiple leaf springs for at least one intermediate actuated position), and the number and pattern of actuations (enabling distinguishing of commands in the manner of a single or multiple click computer mouse.)

In one embodiment, the tail cap 32 may be unscrewed from the housing a sufficient amount to prevent any switch contacts from making contact even when the button is fully pressed, providing a lockout position for storage to prevent inadvertent discharge of batteries or unwanted illumination during critical operations.

For normal operation, the tail cap is screwed tightly to the scope body to an "operational condition." This differs from conventional flashlights that require the tail cap to be in an intermediate rotational position for selective operation (full screw-down providing constant-on operation in such lights). This reduces potential operator error, and avoids the need for testing operational condition to ensure proper rotational position in advance of a critical operation, or after replacement of batteries.

When in the operational condition, displacement of the button to a first intermediate position (or intermediate pressure, for strain gauge buttons) causes the controller to provide power to the lamp for illumination at a pre-selected dimmed level, but only while the button is displaced. This provides momentary illumination, or a "dead man's" capability, so that the light turns off when pressure is ceased.

Displacement to a second intermediate position (such as when a second leaf spring makes contact in the switch, so that the controller detects a different resistance level) causes the controller to operate the lamp at the same pre-selected dimmed level, but with sustained operation upon release of the button. The switch may include a mechanical detent mechanism to provide tactile feedback to the operator to indicate that sustained illumination will be provided, or the rubber boot on the tail cap button may be designed with an over-center operation characteristic that provides a distinctive tactile feel when pressure beyond the required level to reach the second intermediate position is provided. In alternative embodiments, feedback devices may include electronic transducers in the flashlight connected to the controller, such as an audio annunciator that provides a "click" sound, or tactile transducers such as piezoelectric devices that provide a tactile response.

When illuminated at the preselected dimmed level, any pressure of the button less than the second intermediate position has no effect, while pressure beyond the threshold that led to sustained illumination and release beyond the first intermediate level will cease illumination.

When in the off condition, or when illuminated at the preselected dimmed level, displacement of the switch beyond the second intermediate level to a third or maximum level causes the controller to provide maximum illumination in a "panic" mode. In one embodiment, full pressure on the switch generally causes sustained illumination at the maximum illumination level. To avoid unintended max illumination when a user intending to "click on" at the preselected dimmed level inadvertently presses momentarily with excessive force to the third level, the controller is programmed to provide sustained max illumination only when the contact at the third level is made for more than a brief pre-selected duration. In such an embodiment, the momentary click by a user to invoke the pre-set dimmed level may result in a momentary flash at the max brightness level, but this ensures that users requiring max brightness receive immediate illumination. In an alternative embodiment where immediate max illumination is not critical, the controller may be programmed to delay max illumination until after the button has been depressed more than the momentary threshold, avoiding the max flash when intermediate lighting is desired. In such an embodiment, maximum output is slightly delayed to ensure at least slightly sustained duration of pressure more than the fraction of a second that would correspond to accidental excess pressure.

From the maximum illumination condition, pressure on the switch beyond the third displacement amount and release of pressure will cease illumination. The controller may be programmed to return from the max illumination to the preselected dimmed level based on whether the light was operating in the preselected level when the max illumination was initiated. The controller may alternatively be programmed to select an illumination condition upon cessation of max illumination based on the degree of switch actuation, such as by turning off after pressure to (and release from) the third level, and by switching to the preselected level after pressure to (and release from) the second level.

In alternative embodiments, the capability to detect switch application duration enables significant flexibility of function. For instance, the max brightness operation may be established as either sustained or momentary based on duration of application beyond the first brief time threshold set to avoid intended max illumination as discussed above. For switch pressure sustained longer than a second threshold greater than the first, the controller provides momentary max illumination only during such pressure. For pressure more than the first duration but less than the second (such as a deliberate but brief application) the action is read by the controller as a "click on" command.

The programmability and flexibility of the switch control provides further advantages in alternative embodiments. Programming may be fixed, or customized based on institutional purchaser requirements, or programmed on an individual basis by each operator. Some applications will prefer programming that avoids accidental max illumination (such as for infantry troops operating at night), while other applications will prefer ready access to max illumination without delay or difficulty (such as for police work).

The programmable capability of the controller with the electronic switch will provide the user (or a service agency) the capability to re-program the operating characteristics of the device. For instance, where a second dim-level control switch is not desired, the user may invoke a programming mode by a selected sequence of switch actuations. This may be a sequence of pressures to different degrees, a sequence of a number of clicks, or a sequence of clicks of different durations, such as Morse code. Once in a selected programming mode, pressure on the switch may cause the light level to ramp up gradually, so that the user sets the preselected dimmed level by releasing the switch when the dimmed level is desired. Such a mode might be invoked by a simple double click of the switch.

For a flashlight having more than one different light source, such as having multiple colors, the user may program the color (or invisible wavelength) to be output at different modes. This may include selecting hue based on which of several different color lamps (such as RGB LEDs) are illuminated, and in what relative brightnesses. The ability to record and store sequences of different durations also permits the storage of messages (such as entered by Morse code) and subsequent transmission in a regulated format that is readily receivable by other electronic devices. With the fast response time of LED lamps relative to incandescent, such messages may be "hidden" during flashlight operation (in visible or infrared wavelengths) as brief, possibly imperceptible variations of the output level.

The controller may be of any conventional type, programmed and programmable for the various functions above, the circuitry includes a power switching device such as a FET that operates to provide a selected power level to the lamp(s) based on the controller input.

Figure 5:
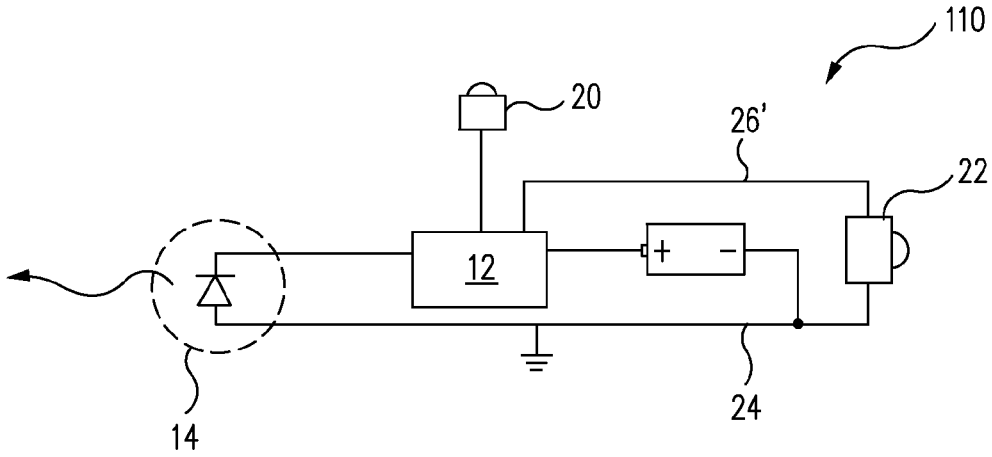
FIG. 5 is a simplified block diagram of a flashlight according to an embodiment of the invention.

FIG. 5 shows an alternative circuit block diagram of a flashlight 110 having the same capabilities as that illustrated in FIG. 1, but with the sleeve (or alternate second conductive path) 26' being connected only between the switch and the controller, so that the battery power loop passes through the housing ground 24. This may be suitable for applications in which the second conductive path 26' has a high resistance, or low current carrying capability.

While the above is discussed in terms of various embodiments, the invention is not intended to be so limited. For instance, many of the above functions and features of a programmable controller may be provided by other means, and the interface between the switch (which may be located at any position) and the controller need not be hard-wired, but may include data transmitted by radio frequencies emitted by the switch and received by the controller. Alternatively, communication may be provided by optical means, such as by an infrared emitter on the switch and a corresponding detector associated with the controller. Such optical communication may be made by line of sight in a passage adjacent to the batteries within the tube, through an optical conduit such as a fiber, or through a housing member having optically transmissive qualities.

Figure 6:
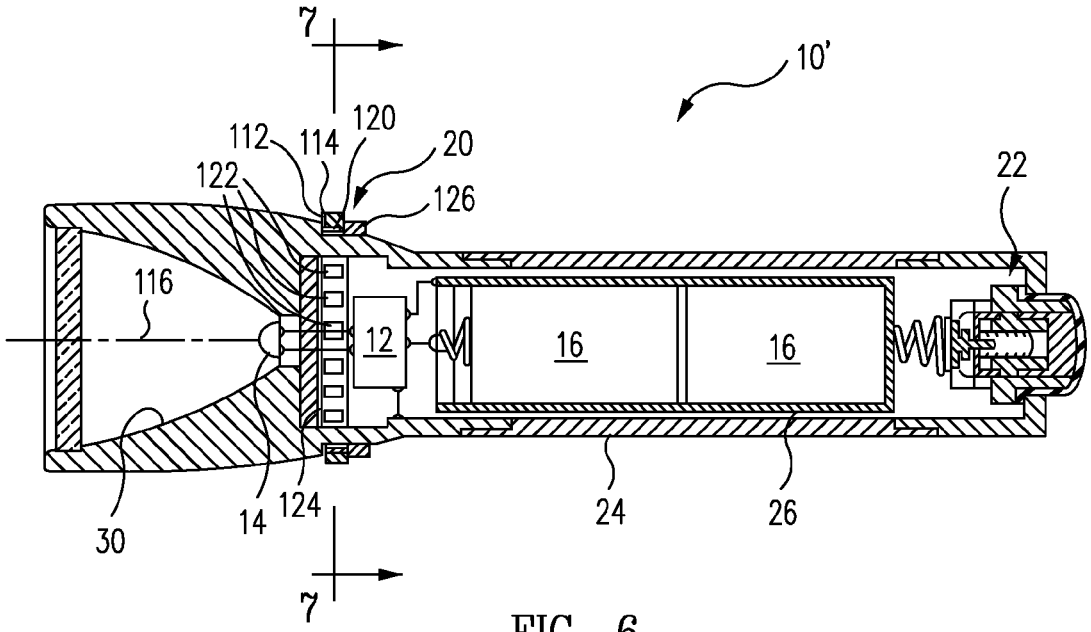
FIG. 6 is a sectional view of a flashlight according to an embodiment of the invention.

FIG. 6 shows a flashlight 10' that is essentially the same as that shown in FIG. 1, except that it has a dimmer control 20' in the form of an annular ring 112 that is received in a channel 114 defined about the periphery of the flashlight's housing 24 at the forward portion that houses the lamp 14. The ring and channel are oriented in a plane perpendicular to the flashlight housing and optical axis 116, and are concentric with the cylindrical housing portion. The ring includes an embedded magnet 120 facing toward the center of the ring. The flashlight includes a plurality of Hall effect magnetic field sensors 122 that operate to detect whether or not the magnet is adjacently positioned. The sensors are connected to the control circuit 12, which receives a signal to determine the angular position of the ring at any time.

Figure 7:
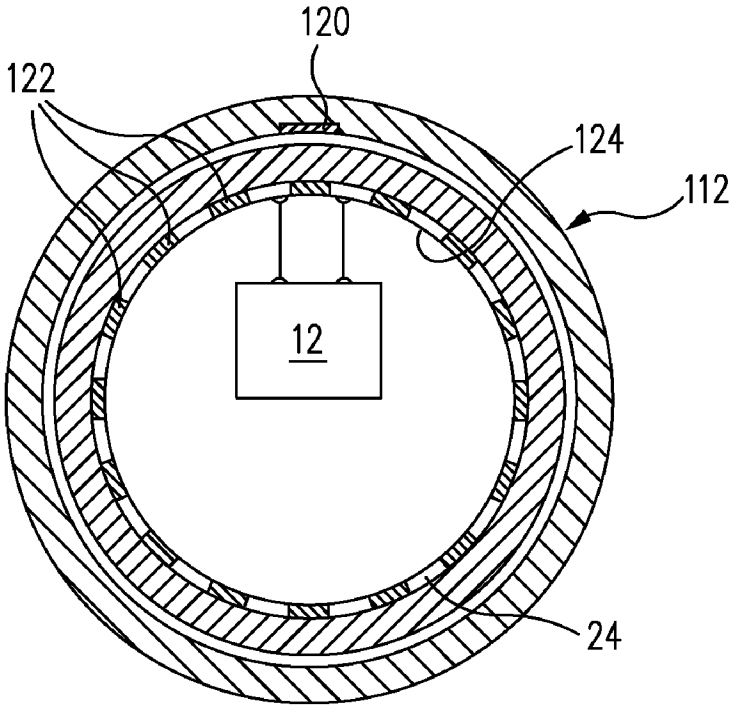
FIG. 7 is an axial sectional view of the dimmer switch mechanism of the embodiment of FIG. 6 taken along line 7-7.

The sensors 122 may be embedded in the housing, such as embodiments in which the housing is molded plastic; in one embodiment, the sensors 122 are attached to a flexible circuit element 124 as shown. As shown in FIG. 7, the flex circuit encircles the interior chamber of the housing, against the outer wall adjacent to the channel 114. The circuit includes between 6 and 20 sensors, which are interconnected to the control circuit. This number may vary beyond this range for other applications. With this arrangement, the control circuit operates to detect the absolute position of the ring.

Referring back to FIG. 6, the housing's forward bezel portion includes a threaded ring 126 that engages threads on the housing to provide one shoulder or wall of the channel, With the threaded ring being separable from the housing, installation and removal of the switch ring 112 is permitted. Although not shown, a friction device such as a rubber O-ring, felt pad, or spring biased detent may be provided to prevent the ring 112 from turning unintentionally, so that a definite amount of torque is required to change the dim level, avoiding inadvertent changes.

The ring 112 serves to allow the user to establish a state for operation of the flashlight, within a range of discrete options corresponding to the number of sensors 122. In one embodiment, the ring establishes a power or dimmed level for the output of the lamp when the tail cap switch is in an intermediate position or has otherwise been operated to indicate a selected intermediate brightness level. The user may rotate the ring in advance of operation, setting the ring to a known number or other indicia printed on the housing and ring. Alternatively, the user may trigger the intermediate dimmed illumination mode by any of the means noted above, and rotate the ring until a satisfactory brightness is achieved.

Figure 10:
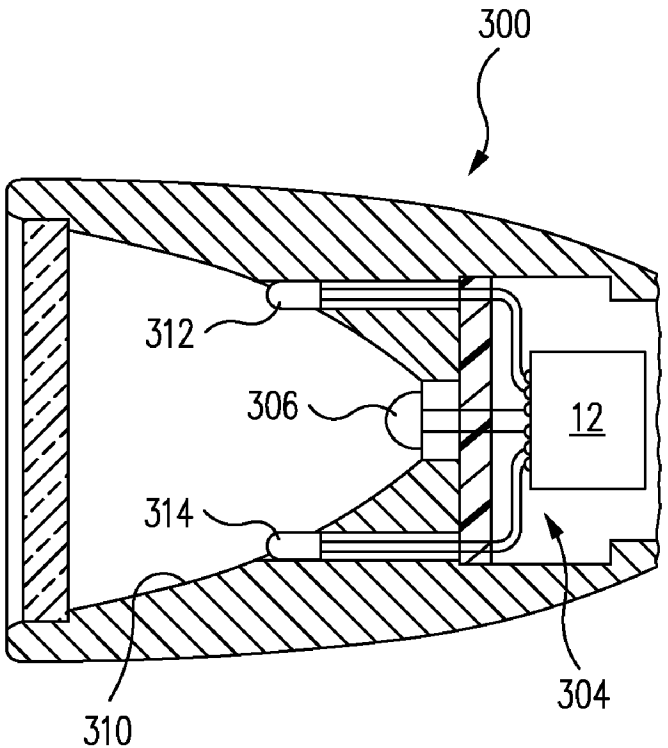
FIGS. 9 and 10 illustrate alternative multiple color lamp alternatives.

In alternative embodiments, the ring may be used to set a second brightness level, such as the maximum level, by rotating to a selected position when the light is illuminated in the maximum mode. The flexibility offered by the control circuit and switches further allows for the setting of any number of brightness levels, which may be achieved by various combinations of inputs related to those noted above with respect to one embodiment, including multiple clicks, and inputs of different durations. The dimmer switch ring may further be used to establish a color output, such as with lamps having variable or different color lamps (as will be illustrated in FIGS. 9 and 10) so that the position of the ring determines which lamp or lamps are illuminated, and in which combination. The light may also be provided with an additional mode that prevents unexpected over-bright operation that would reveal a military position or impair night vision by always reverting to the dimmest level until the switch ring 112 is repositioned to a selected brightness level.

Figure 8:
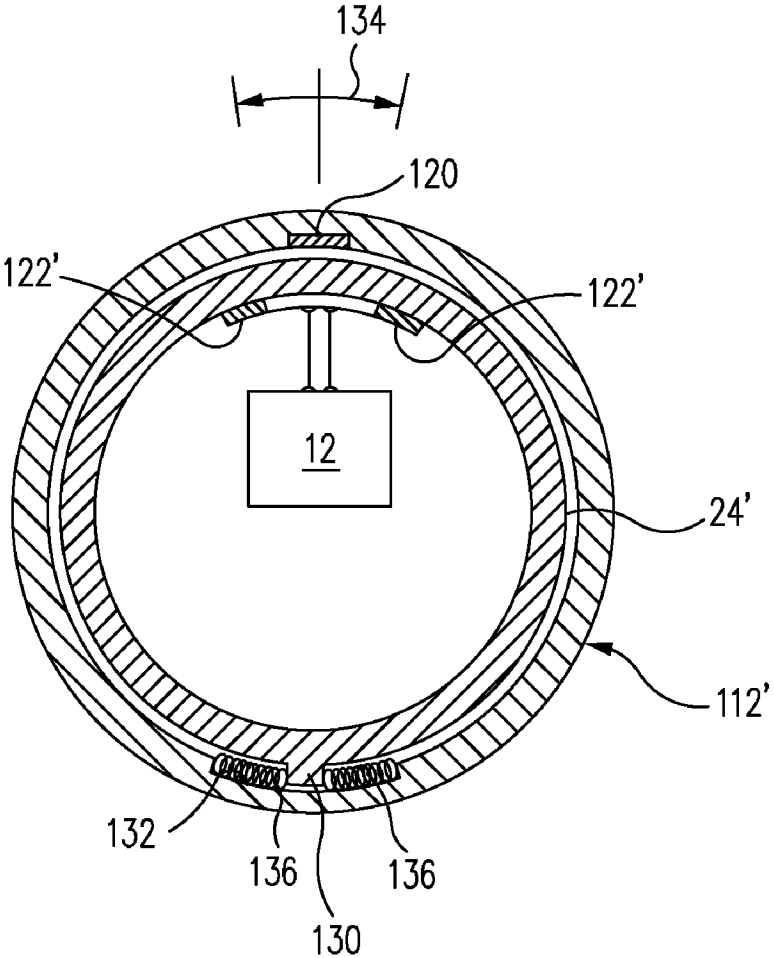
FIG. 8 is an axial sectional view of the dimmer switch mechanism of an embodiment of the invention.

FIG. 8 shows an alternative embodiment dimmed level switch ring 112' in which the dimmed level is based not on the absolute position of the ring, but is adjusted by momentarily imparting slight rotation to the ring 112'. In this embodiment, the housing 24' includes a protruding key 130 in the channel. The ring 112' has a corresponding slot 132 that receives the key. Because the slot is of limited length, the rotation of the ring is limited as the key abuts the ends of the slot at the extremes of travel. This limits angular displacement as indicated by angle 134. The ring is spring biased to a neutral position, as schematically indicated by springs 136. The ring includes a magnet 120, which activates Hall effect sensors 122' that are positioned for activation at the respective limits of rotation. Thus, the controller can detect three different states: first, when the ring is released and at the neutral position, providing no response from either sensor, or when either sensor is triggered by full rotation of the ring to a respective extreme direction.

The FIG. 8 embodiment operates by the control circuit 12 maintaining a selected dimmed level state in memory, and incrementing that state upward or downward by a degree based on the duration the ring is held at a respective limit position. As with the FIG. 7 embodiment, this may be done while the light is illuminated, but may alternatively be done while the light is off, such as by using indicator lights or a display (not shown) to indicate the selected dimmed brightness level. The level may be set by a series of brief impulses in either direction, each incrementing the dimmed level by a nominal amount. This alternative interface may be used to achieve all of the functions as with the FIG. 7 embodiment, including color selection and entry of data and programming codes.

Figure 9:
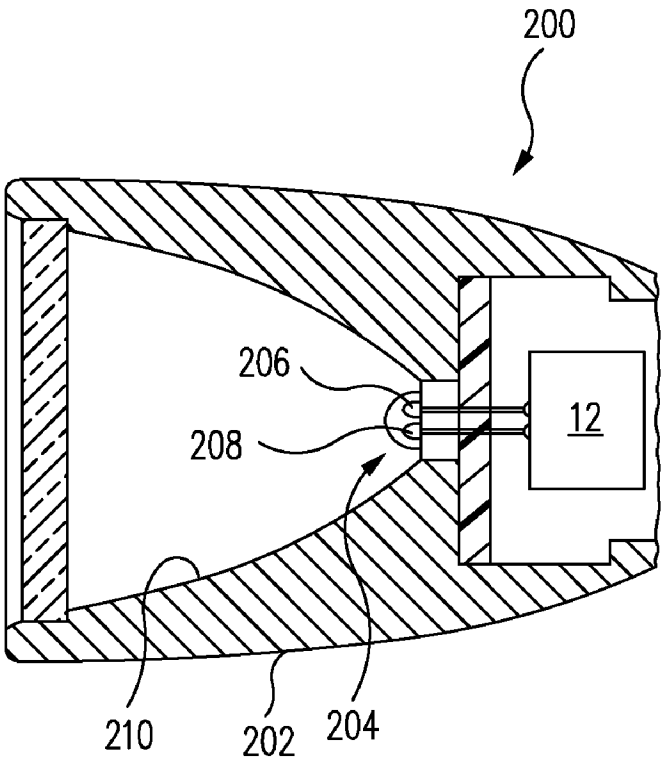

FIG. 9 shows a flashlight 200 having an alternative lamp arrangement for multiple color operation. The flashlight has a housing 202 containing a lamp assembly 204 having more than one different color LED 206, 208 at or near the focus of a primary lens 210. This may include more than two LEDs, to provide a full spectrum of color, such as by providing red, blue, and green LEDs. An infrared or other non-visible emitter may also be included. The FIG. 10 embodiment shows a further alternative light 300 having a housing 302 containing a lamp assembly 304 having a first lamp such as a bright white LED 306 at the primary focus of a reflector 310, with separate LED lamps 312, 314 of different colors having integral lenses and penetrating apertures in the housing. This may be useful for the full color spectrum option noted above, as well as other approaches that use the primary source for a bright beam providing maximum brightness, and the other lamps for specialized uses, such as a red LED for night vision preservation. For instance the tail cap switch may provide illumination of a red LED with slight pressure, illumination of the main lamp to a dimmed level with greater pressure, and max illumination of the lamp with full pressure.

This disclosure is made in terms of various embodiments, and is not intended to be so limited.

In accordance with another embodiment of the invention, a flashlight 1110 is provided that may be operated in a variety of different modes selected by a user. In particular, flashlight 1110 includes washers 1170 and 1180 in a tailcap assembly 1160 of flashlight 1110 that operate as switches to selectively open or close electrical contacts in response to manipulation of various portions of the tailcap assembly (e.g., by a user). Advantageously, the arrangement and configuration of washers 1170 and 1180 in tailcap assembly 1160 permits flashlight 1110 remain compact while still providing a variety of different modes of operation. A selector ring 1116 may also be manipulated (e.g., by a user) to cause flashlight 1110 to operate in various modes.

Figure 11:
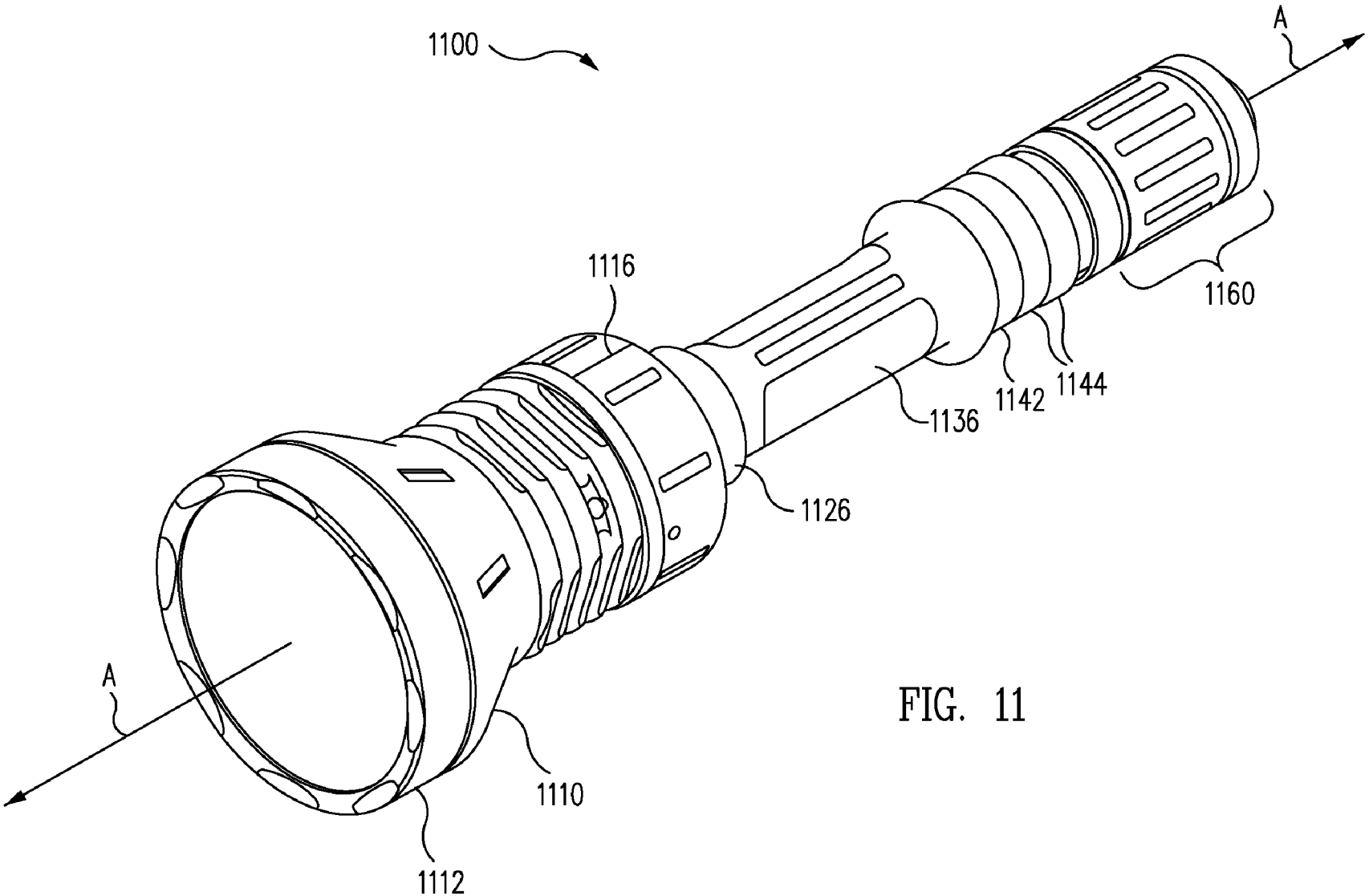
FIG. 11 is a perspective view of a flashlight according to an embodiment of the invention.
Figure 12:
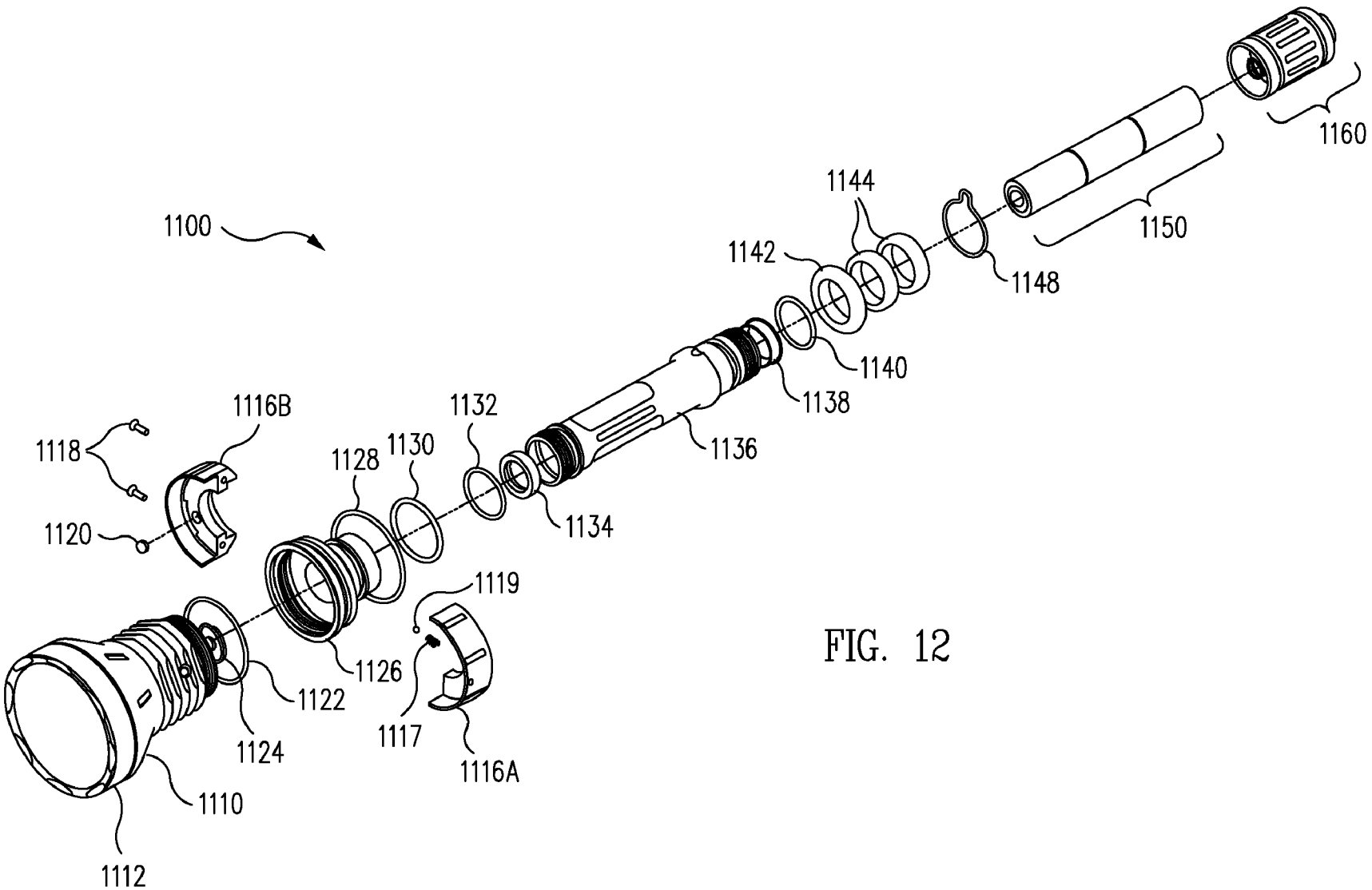
FIG. 12 is an exploded view of the flashlight of FIG. 11.
Figure 13:
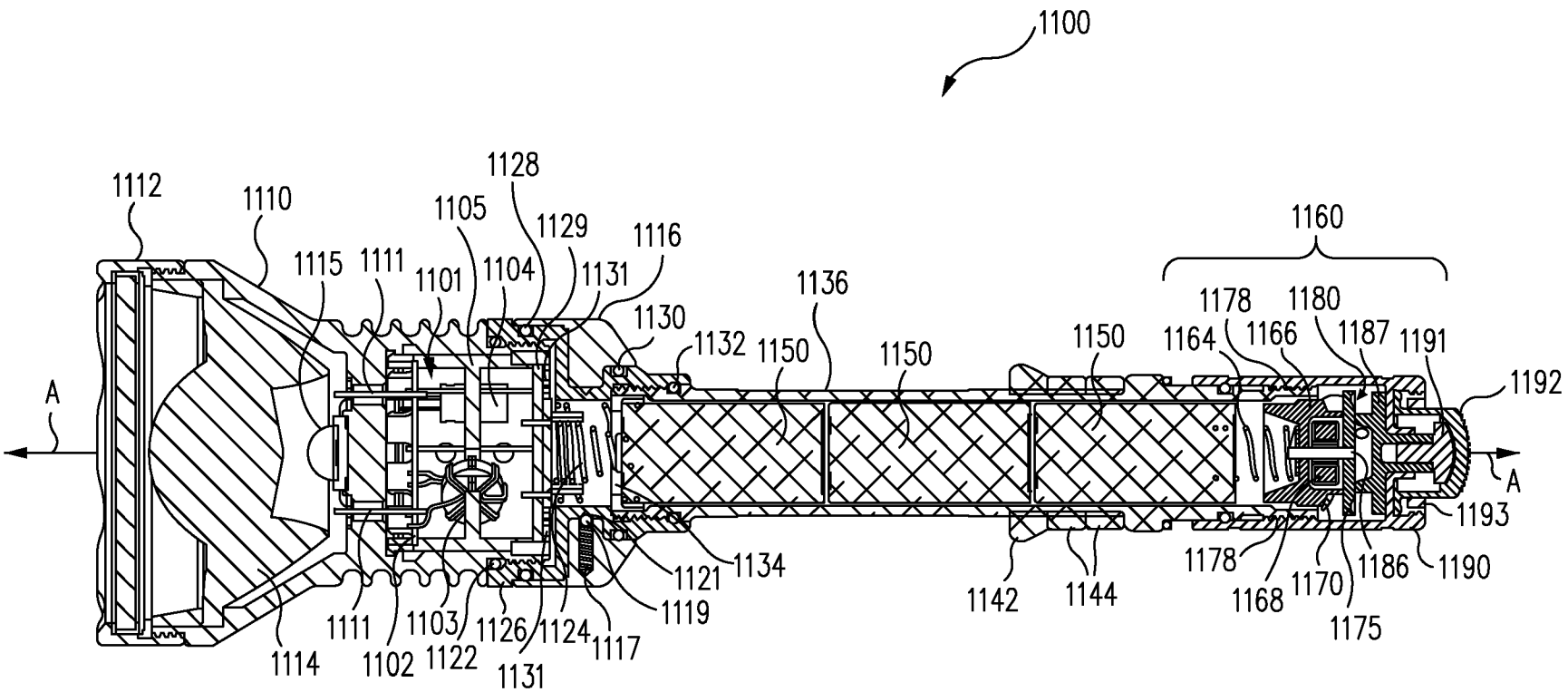
FIG. 13 is a sectional view of the flashlight of FIG. 11.

As shown in FIGS. 11-13, flashlight 1100 includes various components including a heat sink 1110, a bezel 1112, a lens 1114, a light source 1115, a selector ring 1116, o-rings 1122, 1128, 1130, 1132, and 1140, a spring 1124, a coupler 1126, a body 1136, a grip ring 1142, spacer rings 1144, a clip 1148, batteries 1150, and tailcap assembly 1160.

Power sources such as batteries 1150 or other appropriate power sources may be used to power flashlight 1100. Such power sources may be connected to power terminals. For example, in one embodiment, springs 1124 and 1164 (see FIGS. 13-14) may provide power terminals. In particular, spring 1164 may provide a power terminal which may be selectively connected to a processor 1210 (see FIG. 20) and a controller 1220 (see FIG. 20) through tailcap assembly 1160 and body 1136.

For example, in one embodiment, washer 1170 of tailcap assembly 1160 may be used to selectively connect the power terminal provided by spring 1164 (e.g., or any other appropriate power terminal) to processor 1210 and controller 1220. In this regard, washer 1170 may selectively contact a surface such as a surface of body 1136 or any other appropriate surface (e.g., a wire, electrical trace, and/or any other appropriate conductor).

In one embodiment, washer 1170 may selectively connect the power terminal provided by spring 1164 to processor 1210 and controller 1220 through body 1136. In various embodiments, body 1136 may optionally include bushings 1134 and/or 1138. In this regard, bushing 1138 may be used to provide a hard conductive surface to be selectively contacted by washer 1170 (e.g., bushing 1138 may be a surface of body 1136 selectively contacted by washer 1170). For example, in one embodiment, bushings 1134 and 1138 may be nickel plated brass bushings, and other materials may be used in other embodiments.

In another embodiment, washer 1170 may selectively contact body 1136 directly (e.g., body 1136 itself may be the surface selectively contacted by washer 1170). In one embodiment, body 1136 may be an aluminum body, and other materials may be used in other embodiments.

Lens 1114 may be implemented, for example, as a total internal reflection (TIR) lens or any other appropriate lens. Light source 1115 may be implemented as an LED, a tungsten filament lamp, an ARC Lamp, or any other appropriate light source.

Selector ring 1116 may be rotated substantially about an axis A of flashlight 1100 to adjust the operation of flashlight 1100 as further described herein. Selector ring 1116 may be implemented by portions 1116A and 1116B which may be connected together by screws 1118. Selector ring 1116 may be held in various selected positions through the cooperation of a spring 1117 and a ball bearing which exert force toward detents 1121 in coupler 1126. A magnet 1120 may be positioned in a recess of portion 1116B of selector ring 1116 and may be detected by one or more Hall effect sensors 1131 to permit flashlight 1100 to detect a position of selector ring 1116.

Flashlight 1100 also includes various electronic components 1101 that are provided in and/or near a housing 1105. Such electronic components include, for example, a printed circuit board (PCB) 1102, an inductor 1103, a capacitor 1104, posts 1111, and a PCB 1129.

In particular, PCB 1102 may include a processor 1210 (see FIG. 20) which may be configured with appropriate hardware (e.g., one or more micro-processors, logic, or other hardware) and instructions (e.g., software) in a memory to operate light source 1115 in accordance with various techniques described herein. Posts 1111 connect various ones of the electronic components 1101 to light source 1115.

PCB 1129 may include one or more Hall effect sensors 1131 which may cooperate with magnet 1120 to permit flashlight 1100 to detect a position of selector ring 1116. For example, in one embodiment, eleven Hall effect sensors 1131 may be distributed about a perimeter of PCB 1129 corresponding to eleven different positions to which selector ring 1116 may be rotated. In this regard, as selector ring 1116 rotates substantially about axis A to each of the eleven different positions, magnet 1120 may be positioned in proximity to a different one of Hall effect sensors 1131 for each position of selector ring 1116. As a result, a controller 1220 (see FIG. 20) of PCB 1102 may detect the position of selector ring 1116 based on the interaction of magnet 1120 with one or more of the Hall effect sensors 1131. In this regard, controller 1220 may be configured with appropriate hardware (e.g., one or more micro-processors, logic, or other hardware) and instructions (e.g., software) in a memory to provide signals to processor 1210 to operate light source 1115 in accordance with various techniques described herein.

In one embodiment, Hall effect sensors 1131 may be provided as part of controller 1220. In another embodiment, Hall effect sensors 1131 and controller 1220 may be implemented as separate components. Although eleven Hall effect sensors 1131 and eleven positions of selector ring 1116 have been described, any desired number of Hall effect sensors 1131 and positions of selector ring 1116 may be provided in various embodiments.

Figure 14:
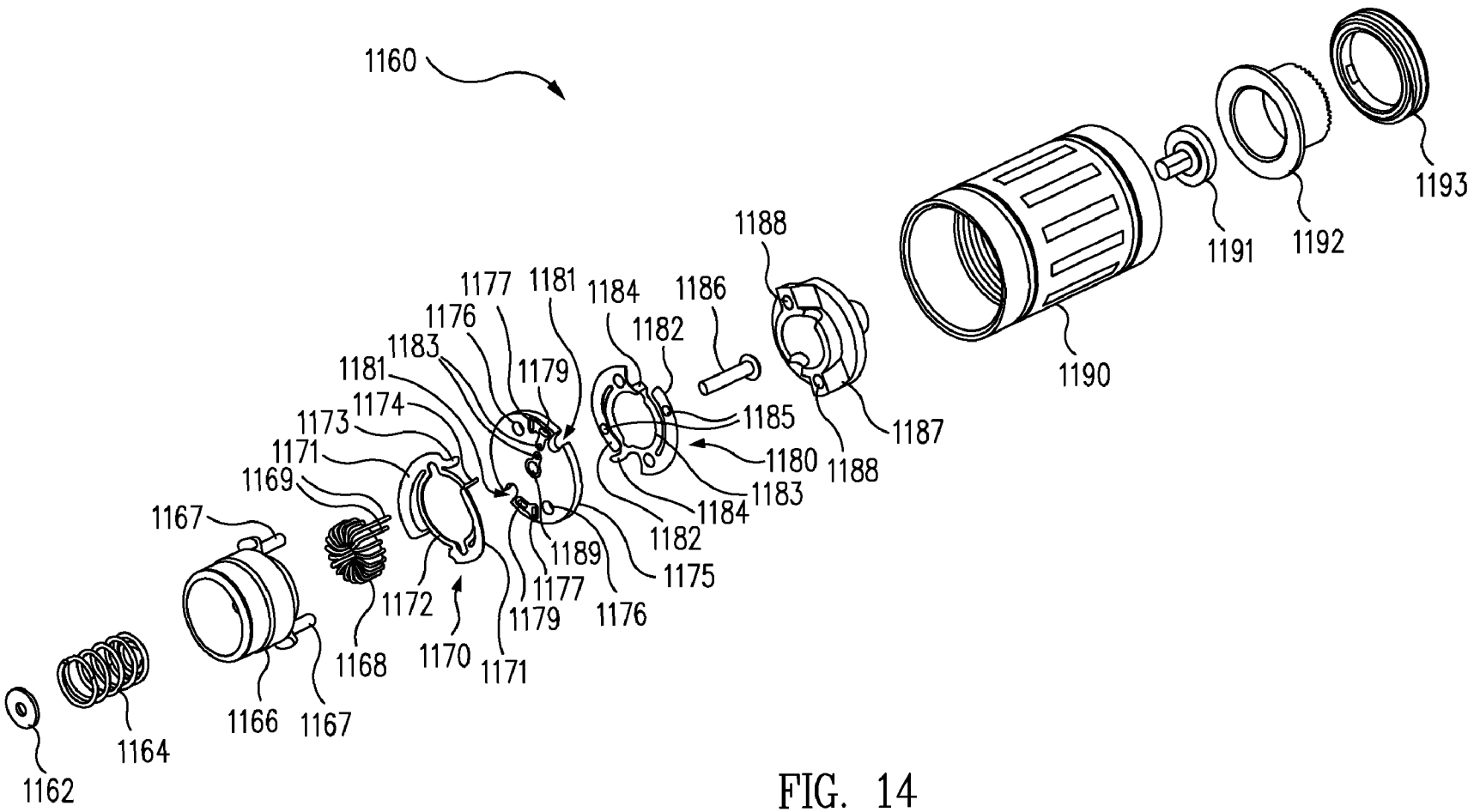
FIG. 14 is an exploded view of a tailcap assembly of the flashlight of FIG. 11.

Referring now to FIGS. 13-14, tailcap assembly 1160 includes washers 1162, 1170, and 1180, spring 1164, a spring retainer 1166 with protrusions 1167, an inductor 1168 with leads 1169, a PCB 1175, an eyelet 1186, retainers 1187 and 1193, a tailcap 1190, a push button 1191, and a cap 1192.

Washers 1170 and 1180 are conductive washers implemented with various features to perform electrical switching operations in cooperation with PCB 1175 in response to manipulation of tailcap assembly 1160. In particular, washers 1170 and 1180, and PCB 1175 may move substantially along axis A in response to rotation of tailcap 1190 by a user (e.g., by rotation of tailcap 1190 relative to body 1136 through the engagement of complementary threads 1178) and also in response to the depressing of push button 1191. In one embodiment, washers 1170 and 1180 may be mounted on substantially opposite sides of PCB 1175.

As shown in FIGS. 14 and 16A-C, washer 1170 includes arms 1171, a center ring 1172, and tabs (e.g., protrusions) 1173 and 1174. Arms 1171 project away from center ring 1172 and may be used to selectively contact body 1136 (e.g., either directly or through bushing 1138) to provide an electrical switch. Tabs 1174 project from arms 1171 back toward center ring 1172 and may be used to selectively interrupt contacts between washer 1180 and PCB 1175 to operate an additional electrical switch provided by washer 1180 as further described herein. Tabs 1173 may be used to engage washer 1170 with PCB 1175. In one embodiment, washer 1170 advantageously includes two arms 1171. This arrangement provides redundancy such that washer 1170 may still provide switching capability even if one of arms 1171 becomes bent, broken, and/or otherwise unable to provide an electrical switch.

As shown in FIGS. 14 and 17A-C, washer 1180 includes arms 1182, a center ring 1183, tabs (e.g., protrusions) 1184, and dimples 1185 on arms 1182. Dimples 1185 may be used to selectively contact end portions 1194 of a conductor 1197 (e.g., an electrical trace) of PCB 1175. In this regard, electrical contacts between dimples 1185 and end portions 1194 of PCB 1175 may be selectively interrupted in response to tabs 1174 of washer 1170 pushing arms 1182 away from PCB 1175. Tabs 1184 may be used to engage washer 1180 with PCB 1175.

Figure 18A:
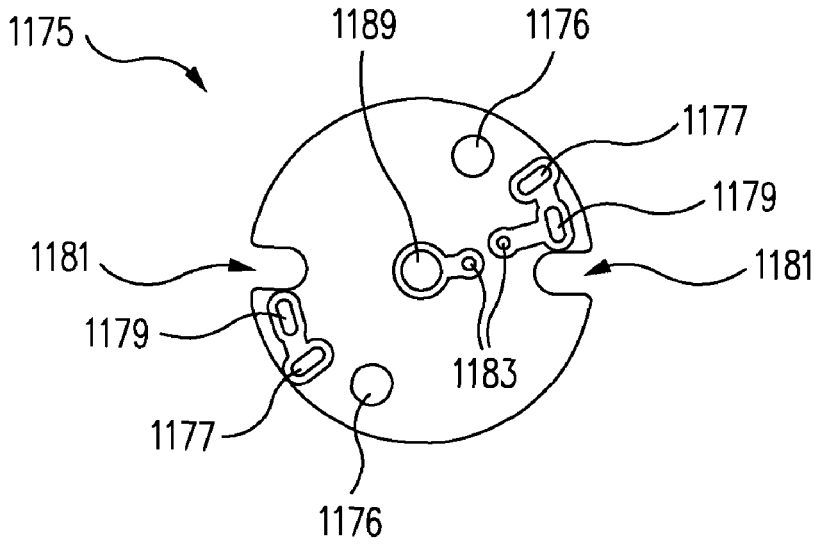
FIGS. 18A-B are various views of a printed circuit board (PCB) of the flashlight of FIG. 11.
Figure 18B:
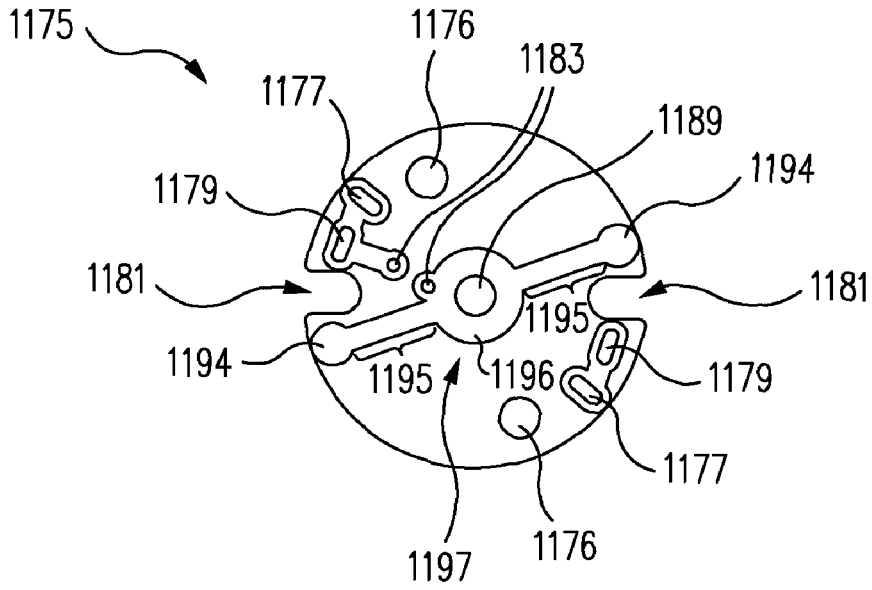

As shown in FIGS. 14 and 18A-B, PCB 1175 includes apertures (e.g., slots) 1176, 1177, 1179, 1183, and 1189, recesses 1181, and conductor 1197. Apertures 1176 may receive protrusions 1167 of spring retainer 1166 to engage PCB 1175 with spring retainer 1166. Apertures 1177 may receive tabs 1173 of washer 1170 to engage washer 1170 with PCB 1175. Apertures 1179 may receive tabs 1184 of washer 1180 to engage washer 1180 with PCB 1175. Apertures 1183 may receive leads 1169 of inductor 1116 to engage inductor 1116 with PCB 1175. Apertures 1189 may receive eyelet 1186 to engage eyelet 1186 with PCB 1175.

Conductor 1197 includes end portions 1194, intermediate portions 1195, and a central annular portion 1196. In one embodiment, intermediate portions 1195 may be electrically insulated to prevent center ring 1183 of washer 1180 from coming into electrical contact with intermediate portions 1195. PCB 1175 includes additional conductive portions as identified by the shaded regions adjacent to apertures 1177, 1179, 1183, and 1189.

Recesses 1181 may receive tabs 1174 of washer 1170 when tailcap assembly 1160 is assembled to permit tabs 1174 to protrude through PCB 1175 and push arms 1182 of washer 1180 away from PCB 1175 and thus interrupt electrical contacts between dimples 1185 of washer 1180 and end portions 1194 of conductor 1197.

Figure 15A:
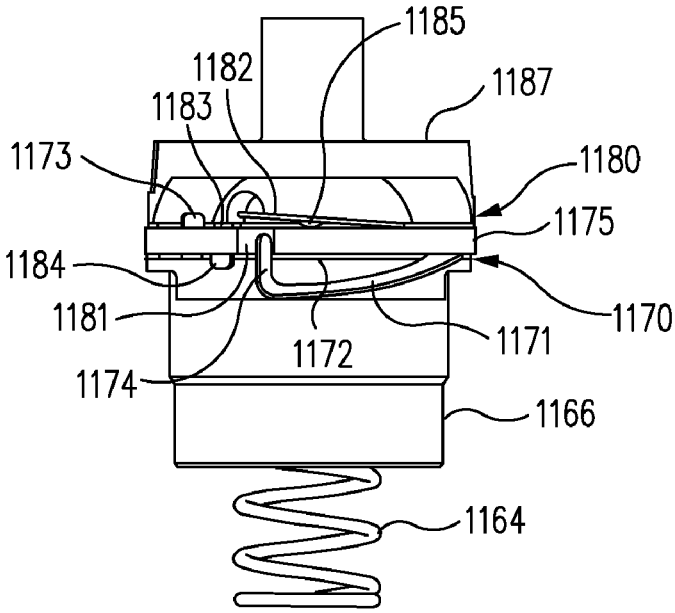
FIGS. 15A-B are side views of a portion of the tailcap assembly of the flashlight of FIG. 11.
Figure 15B:
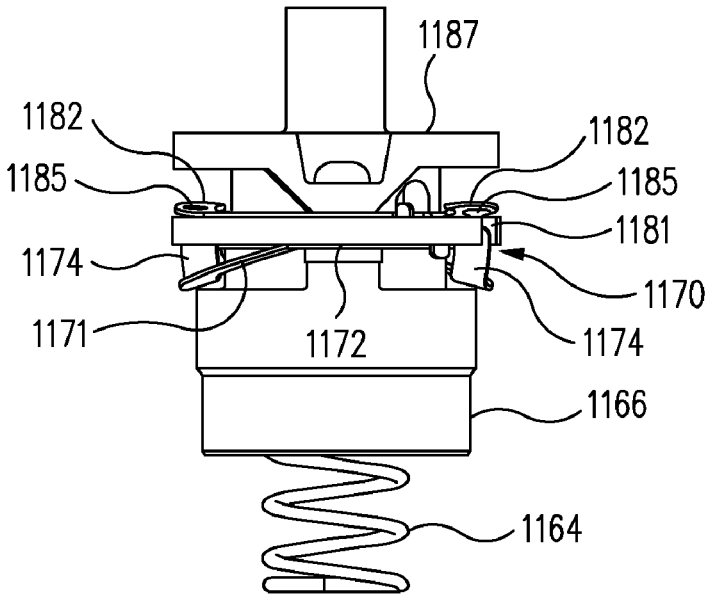
Figure 16A:
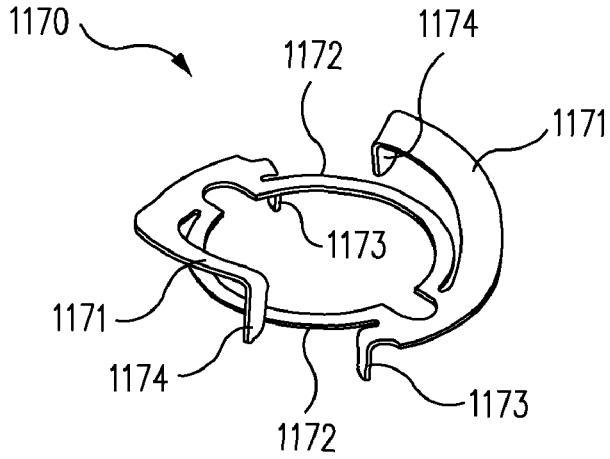
FIGS. 16A-C are various views of a washer of the flashlight of FIG. 11.
Figure 16B:
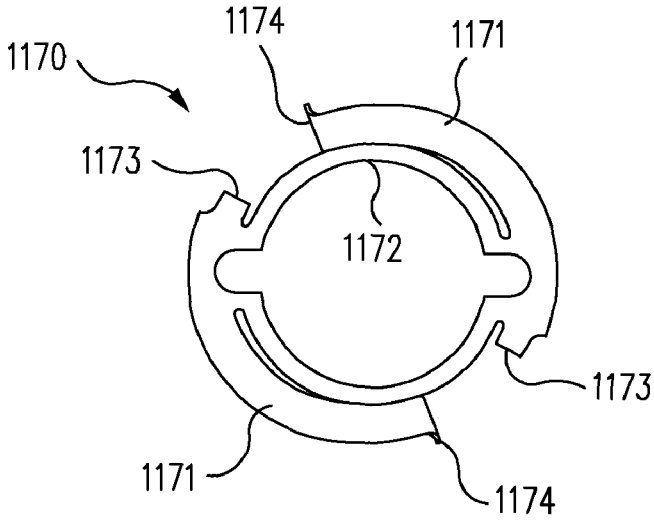
Figure 16C:
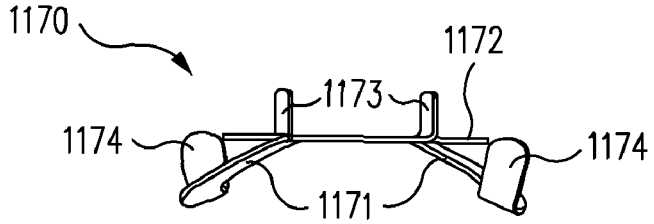
Figure 17A:
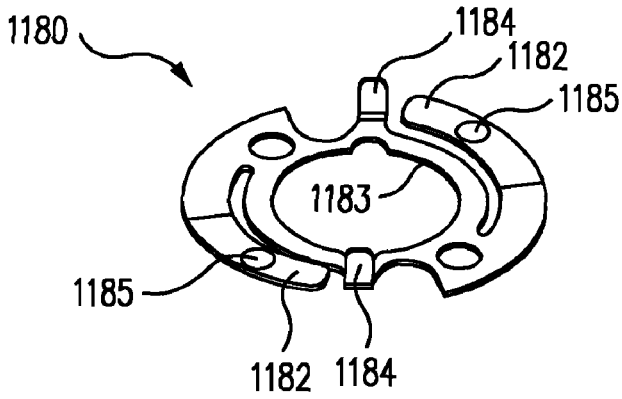
FIGS. 17A-C are various views of another washer of the flashlight of FIG. 11.
Figure 17B:
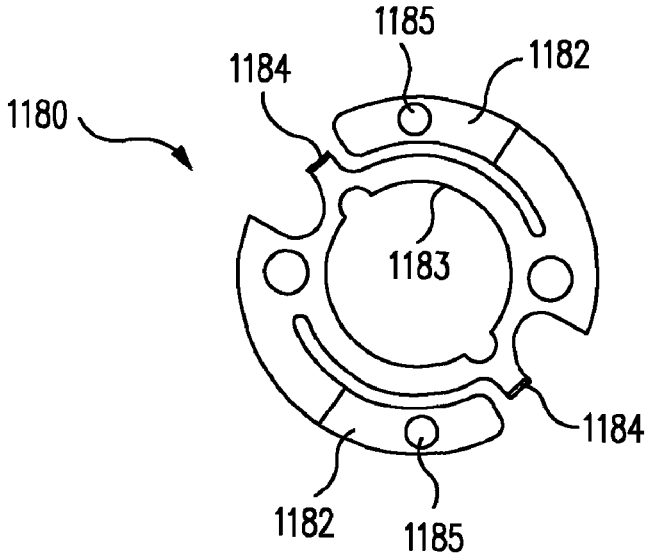
Figure 17C:
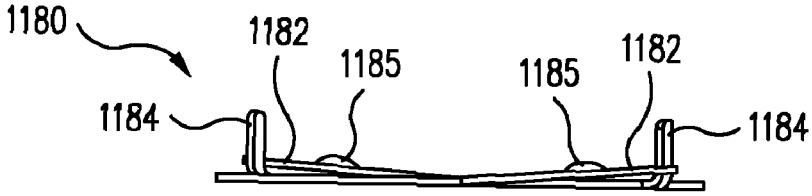

FIGS. 15A-B further illustrate the relative positioning of washers 1170 and 1180, and PCB 1175 for a portion of tailcap assembly 1160. In particular, arms 1171 of washer 1170 are shown projecting away from center ring 1172. In addition, tabs 1174 of washer 1170 are shown projecting through recesses 1181 toward arms 1182 of washer 1180.

As discussed, a user may operate various portions of tailcap assembly 1160 and/or a selector ring 1116 to cause flashlight 1110 to operate in desired modes of operation. In particular, Table 1 identifies various modes of operation which may be provided in response to operation of tailcap 1190 and/or push button 1191.

TABLE 1

| MODE OF OPERATION SELECTED BY TAILCAP ASSEMBLY 1160 | DESCRIPTION | MOVEMENT OF TAILCAP 1190 AND PUSH BUTTON 1191 |
|---|---|---|
| Lockout | Disables selector ring 1116 | Rotate tailcap 1190 fully to lockout position |
| Standby | Allows activation of momentary on stages 1 and 2 | Rotate tailcap 1190 to standby position |
| Momentary on stage 1 | Low beam momentary on | Depress push button 1191 |
| Momentary on stage 2 | High beam momentary on | Further depress push button 1191 |
| Constant on stage 1 | Low beam constant on | Rotate tailcap 1190 to constant on position 1 |
| Constant on stage 2 | High beam constant on | Rotate tailcap 1190 to constant on position 2 |

The various modes of operation identified in Table 1 will be further described with reference to FIGS. 19A-F.

Figure 19A:
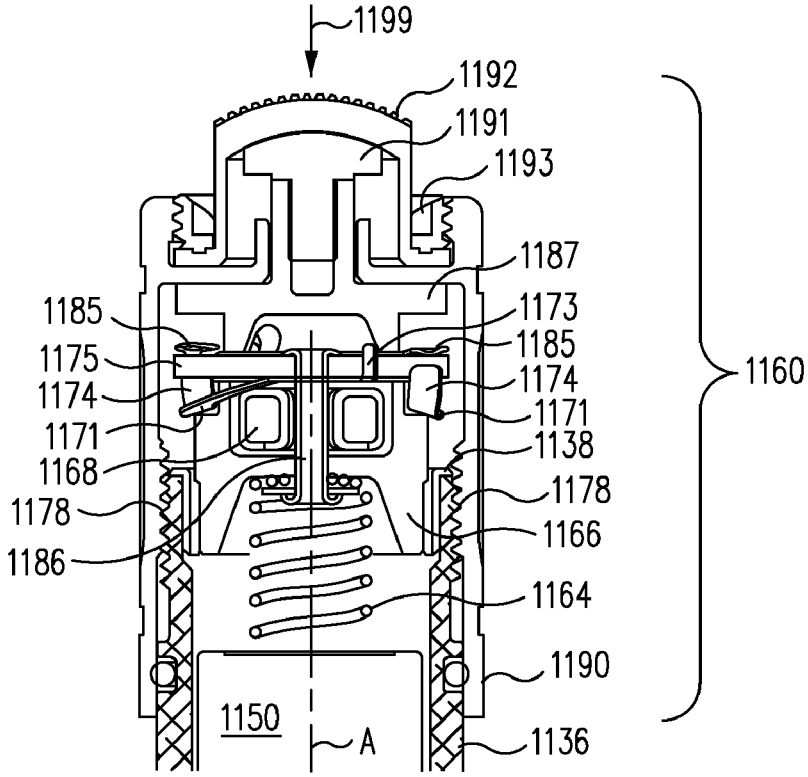
FIGS. 19A-F are sectional views of the tailcap assembly of the flashlight of FIG. 11 when configured to operate in various modes.

FIG. 19A illustrates tailcap assembly 1160 while flashlight 1100 is in a lockout mode of operation. In this case, tailcap assembly 1160 is shown with tailcap 1190 fully rotated to a lockout position. While in this position, washer 1170 is sufficiently disposed away from bushing 1138 and body 1136 such that depressing push button 1191 in the direction of an arrow 1199 will not cause arms 1171 of washer 1170 to contact bushing 1138 or body 1136. As a result, the electrical switch provided by washer 1170 will not be closed, regardless of the disposition of push button 1191. In addition, while tailcap 1190 is in the lockout position, selector ring 1116 may be disabled such that light source 1115 will be prevented from providing (e.g., emitting) any light in response to any manipulation of selector ring 1116.

Figure 19B:
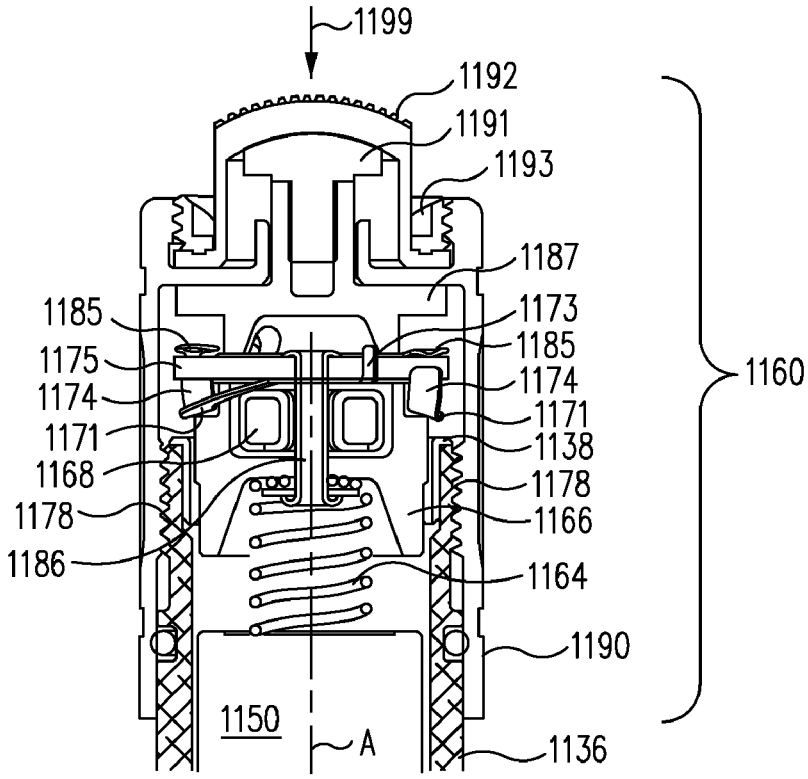

FIG. 19B illustrates tailcap assembly 1160 while flashlight 1100 is in a standby mode of operation. In this case, tailcap assembly 1160 is shown with tailcap 1190 rotated to a standby position. While in this position, washer 1170 is situated closer to bushing 1138 and body 1136 such that depressing push button 1191 in the direction of arrow 1199 will cause arms 1171 of washer 1170 to contact bushing 1138 or body 1136. As a result, the electrical switch provided by washer 1170 may be selectively opened or closed in response to manipulation of push button 1191.

Figure 19C:
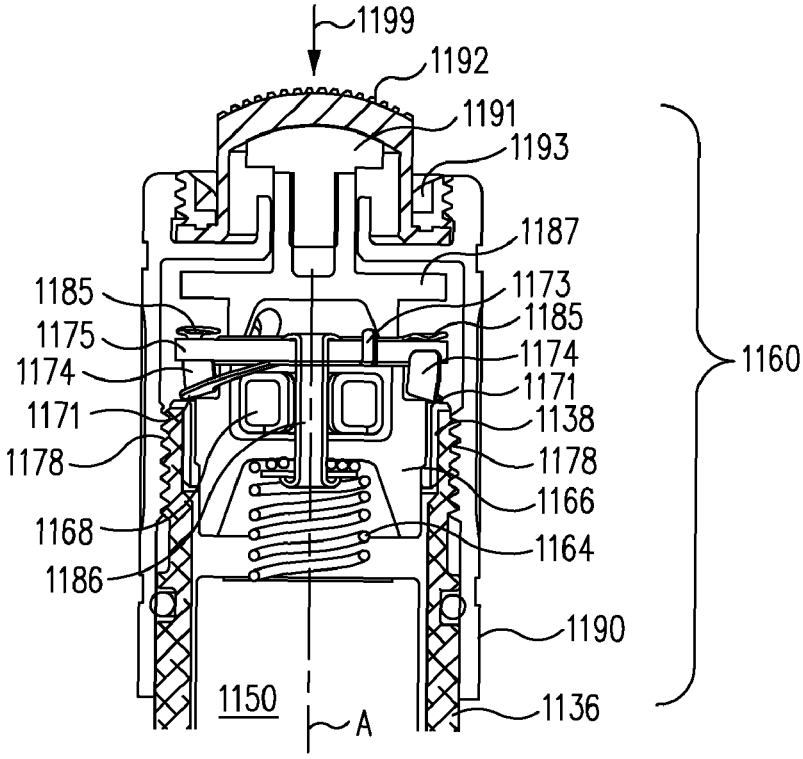

FIG. 19C illustrates tailcap assembly 1160 while flashlight 1100 is in a momentary on stage 1 mode of operation. In this case, tailcap assembly 1160 is shown with tailcap 1190 in the standby position and further with push button 1191 partially depressed in the direction of arrow 1199. As a result, arms 1171 of washer 1170 are shown contacting bushing 1138 or body 1136 which causes the electrical switch provided by washer 1170 to be closed. In this configuration, flashlight 1100 may operate light source 1115 as a low beam light source (e.g., providing less than the maximum light output available from light source 1115). Also in this configuration, flashlight 1100 may operate light source 1115 in a "momentary" manner such that light is only provided while push button 1191 is depressed in the direction of arrow 1199. In this regard, if push button 1191 is released, then flashlight 1100 may return to the standby mode of operation (e.g., as shown in FIG. 19B).

Figure 19D:
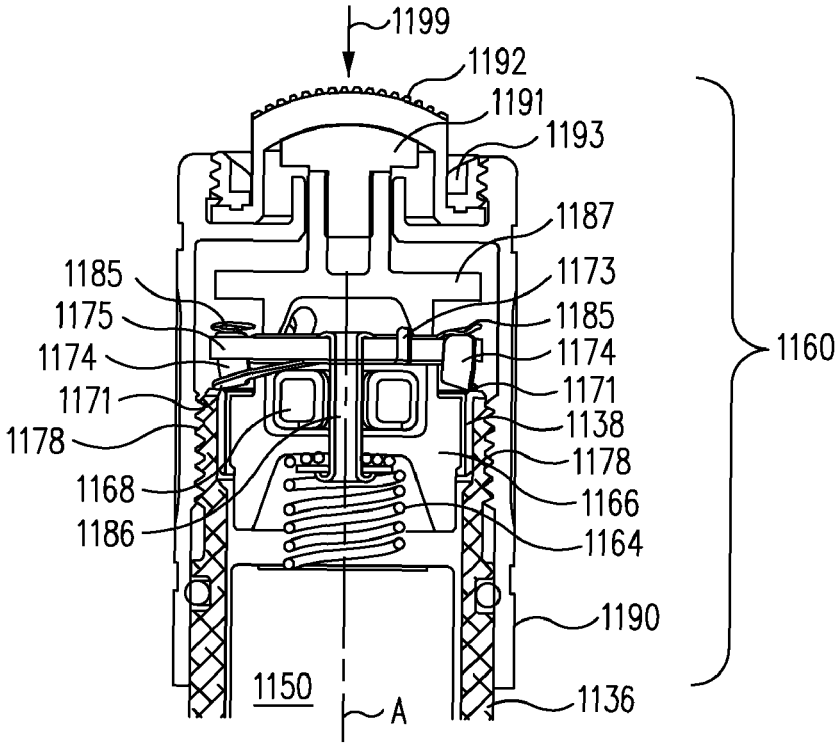

FIG. 19D illustrates tailcap assembly 1160 while flashlight 1100 is in a momentary on stage 2 mode of operation. In this case, tailcap assembly 1160 is shown with tailcap 1190 in the standby position and further with push button 1191 fully depressed in the direction of arrow 1199. As a result, arms 1171 of washer 1170 continue to contact bushing 1138 or body 1136 which causes the electrical switch provided by washer 1170 to be closed.

Also in this case, the full depression of push button 1191 causes arms 1171 of washer to be further pushed against bushing 1138 or body 1136. As a result, tabs 1174 of arms 1171 are pushed upwards through recesses 1181 of PCB 1175 which cause tabs 1174 to push up arms 1182 of washer 1180. This pushing of arms 1182 by tabs 1174 causes dimples 1185 of arms 1182 to break electrical contact with end portions 1194 of conductor 1197. As a result, the electrical switch provided by washer 1180 (e.g., the shorting together of leads 1169 of inductor 1168) may be opened.

In this configuration, flashlight 1100 may operate light source 1115 as a high beam light source (e.g., providing the maximum light output available from light source 1115). Also in this configuration, flashlight 1100 may operate light source 1115 in a "momentary" manner such that light is only provided while push button 1191 is depressed in the direction of arrow 1199. In this regard, if push button 1191 is released, then flashlight 1100 may return to the standby mode of operation (e.g., as shown in FIG. 19B).

Figure 19E:
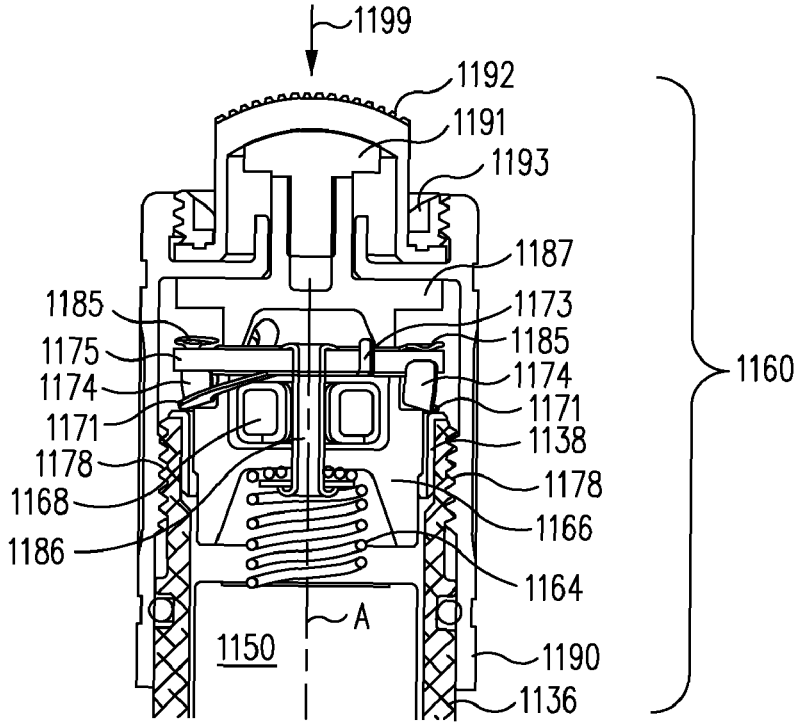

FIG. 19E illustrates tailcap assembly 1160 while flashlight 1100 is in a constant on stage 1 mode of operation. In this case, tailcap assembly 1160 is shown with tailcap 1190 further rotated to a constant on position. While in this position, washer 1170 is situated closer to bushing 1138 and body 1136 such that arms 1171 of washer 1170 contact bushing 1138 or body 1136. As a result, the electrical switch provided by washer 1170 may be closed.

In this configuration, flashlight 1100 may operate light source 1115 as a low beam light source. Also in this configuration, flashlight 1100 may operate light source 1115 in a "constant" manner such that light is provided regardless of whether push button 1191 is depressed in the direction of arrow 1199.

Figure 19F:
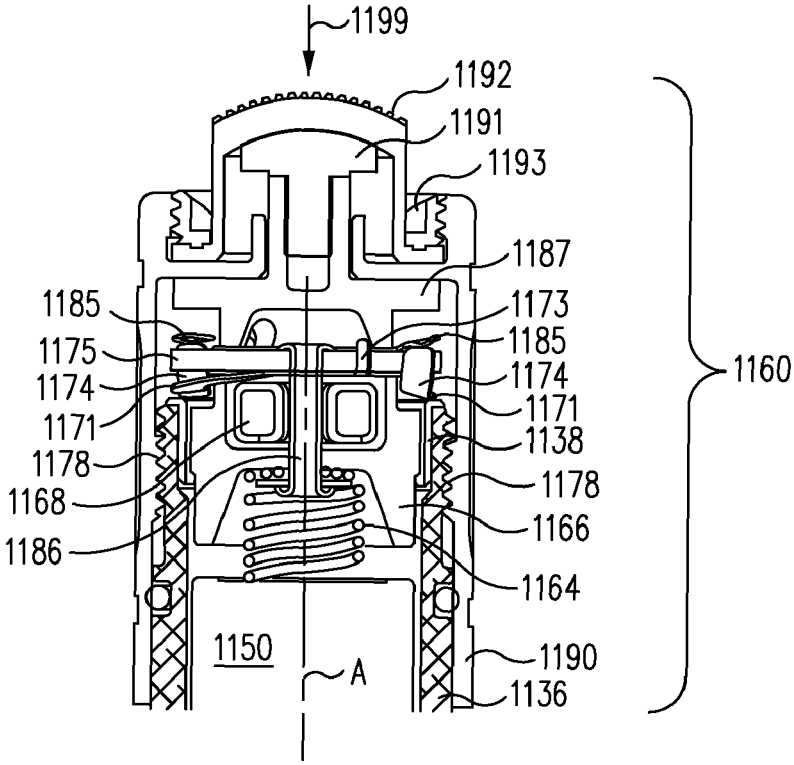

FIG. 19F illustrates tailcap assembly 1160 while flashlight 1100 is in a constant on stage 2 mode of operation. In this case, tailcap assembly 1160 is shown with tailcap 1190 further rotated to another constant on position. As a result, arms 1171 of washer 1170 continue to contact bushing 1138 or body 1136 which causes the electrical switch provided by washer 1170 to be closed.

Also in this case, the closer proximity of washer 1170 to bushing 1138 and body 1136 causes arms 1171 of washer 1470 to be further pushed against bushing 1138 or body 1136. As a result, tabs 1174 of arms 1171 are pushed upwards through recesses 1181 of PCB 1175 which cause tabs 1174 to push up arms 1182 of washer 1180. This pushing of arms 1182 by tabs 1174 causes dimples 1185 of arms 1182 to break electrical contact with end portions 1194 of conductor 1197. As a result, the electrical switch provided by washer 1180 (e.g., the shorting together of leads 1169 of inductor 1168) may be opened.

In this configuration, flashlight 1100 may operate light source 1115 as a high beam light source. Also in this configuration, flashlight 1100 may operate light source 1115 in a "constant" manner such that light is provided regardless of whether push button 1191 is depressed in the direction of arrow 1199.

Thus, it will be appreciated that flashlight 1100 may be operated in various modes in response to selective rotation of tailcap 1190 and/or selective depression of push button 1191. The operation of flashlight 1100 may be further adjusted in response to selective rotation of selector ring 1116. In particular, Table 2 identifies various modes of operation which may be provided in response to operation of selector ring 1116.

As set forth in Table 2, selector ring 1116 may be selectively rotated to various positions to cause flashlight 1100 to operate in different ways. In one embodiment, selector ring 1116 may be rotated to eleven different positions set forth in Table 2. In this regard, each position may be denoted by a corresponding detent 1121 located on coupler 1126 (e.g., a plurality of detents 1121 may be provided substantially about a perimeter of coupler 1126). Spring 1117 may push ball bearing 1119 to engage with each detent 1121 as selector ring 1116 is rotated substantially about axis A of flashlight 1110. Other numbers and/or types of positions are contemplated in other embodiments.

When selector ring 1116 is fully rotated to an "off" position, light source 1115 may be fully disabled such that any rotation of tailcap 1190 and any depressing of push button 1191 will not cause light source 1115 to illuminate. In this regard, while selector ring is in the off position, tailcap assembly 1160 may be disabled such that light source 1115 will be prevented from providing (e.g., emitting) any light in response to any manipulation of tailcap assembly 1160.

When selector ring 1116 is rotated to an "SOS" position, flashlight 1100 may be prepared to switch light source 1115 on and off in a pattern (e.g., an SOS pattern between a maximum brightness level and a substantially zero brightness level, or other pattern). In one embodiment, light source 1115 may be switched in this manner if flashlight 1100 has been configured in any of the following modes (e.g., through operation of tailcap 1190 and/or push button 1191 as set forth in Table 1): momentary on stage 1, momentary on stage 2,

TABLE 2

| MODE OF OPERATION SELECTED BY SELECTOR RING 1116 | DESCRIPTION | MOVEMENT OF SELECTOR RING 1116 |
|---|---|---|
| Off | Disables rear tailcap assembly 1160; rotating tail cap 1190 and depressing push button 1191 will not activate light source 1115 | Rotate selector ring 1116 fully to off position |
| SOS | Light source 1115 flashes SOS pattern or other pattern at maximum brightness level if tailcap 1190 and/or push button 1191 are configured for momentary stages 1 or 2, or constant on stages 1 or 2 | Rotate selector ring 1116 to SOS position |
| Brightness minimum | Light output is progressively brighter based on position of selector ring 1116 if tailcap 1190 and/or push button 1191 are configured for momentary stage 1 or constant on stage 1; light output is fixed at maximum brightness if tailcap 1190 and/or push button 1191 are configured for momentary stage 2 or constant on stage 2 | Rotate selector ring 1116 to brightness minimum position |
| Brightness 1 | | Rotate selector ring 1116 to brightness 1 position |
| Brightness 2 | | Rotate selector ring 1116 to brightness 2 position |
| Brightness 3 | | Rotate selector ring 1116 to brightness 3 position |
| Brightness 4 | | Rotate selector ring 1116 to brightness 4 position |
| Brightness 5 | | Rotate selector ring 1116 to brightness 5 position |
| Brightness 6 | | Rotate selector ring 1116 to brightness 6 position |
| Brightness maximum | | Rotate selector ring 1116 to brightness maximum position |
| Strobe | Light source 1115 flashes strobe pattern or other pattern at maximum brightness level if tailcap 1190 and/or push button 1191 are configured for momentary stages 1 or 2, or constant on stages 1 or 2 | Rotate selector ring 1116 to strobe position |

constant on stage 1, or constant on stage 2. In one embodiment, the maximum brightness level provided by light source 1115 may be approximately 400 lumens, however other brightness levels may be used in other embodiments.

When selector ring 1116 is rotated to a "brightness minimum" position, a "brightness maximum" position, or any of the intermediate brightness ("brightness 1-6") positions, flashlight 1100 may be prepared to turn on light source 1115 to provide constant light output. In this regard, the light output may vary depending on the particular one of the brightness positions selected (e.g., a low light output may be provided by the brightness minimum position, progressively brighter light output may be provided by the brightness 1-6 positions, and maximum light output may be provided by the brightness maximum position).

In one embodiment, light source 1115 may provide the various low, intermediate, and maximum light output if flashlight 1100 has been configured in any of the following modes (e.g., through operation of tailcap 1190 and/or push button 1191 as set forth in Table 1): momentary on stage 1 or constant on stage 1. Also in this embodiment, light source 1115 may provide only maximum light output while selector ring 1116 is rotated to any of the brightness minimum, brightness maximum, or intermediate brightness positions if flashlight 1100 has been configured in any of the following modes (e.g., through operation of tailcap 1190 and/or push button 1191 as set forth in Table 1): momentary on stage 2 or constant on stage 2.

When selector ring 1116 is rotated to a "strobe" position, flashlight 1100 may be prepared to switch light source 1115 on and off in a strobe pattern (e.g., a flashing on and off pattern between a maximum brightness level and a substantially zero brightness level, or other pattern). In one embodiment, light source 1115 may be switched in this manner if flashlight 1100 has been configured in any of the following modes (e.g., through operation of tailcap 1190 and/or push button 1191 as set forth in Table 1): momentary on stage 1, momentary on stage 2, constant on stage 1, or constant on stage 2.

In one embodiment, controller 1220 may be configured (e.g., adapted) to return light source 1115 to a brightness level selected by selector ring 1116 following a disconnection and reconnection of controller 1220 to the power terminal (e.g., spring 1164) by washer 1170 without requiring an adjustment of selector ring 1116. In this regard, flashlight 1100 may "remember" the current brightness level (e.g., or other mode of operation) based on the interaction between magnet 1120 and one or more of Hall effect sensors 1131 (e.g., even after tailcap 1190 has been rotated between various positions and/or after push button 1191 has been depressed and/or released).

In view of the above discussion, it will be appreciated that flashlight 1100 may be operated in various modes in response to the configuration of tailcap 1190, push button 1191, and selector ring 1116.

Figure 20:
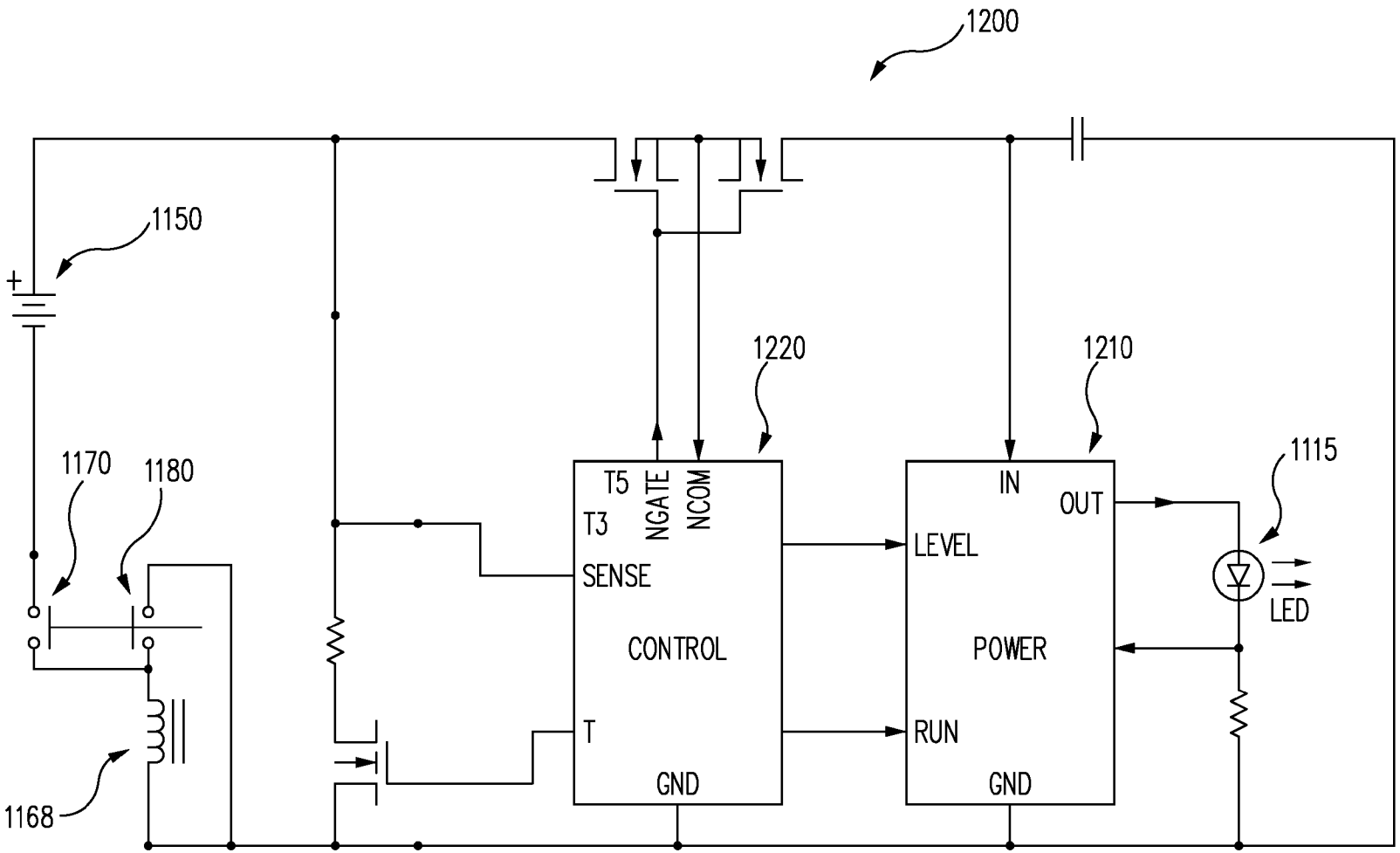
FIG. 20 is a circuit diagram which may be used to implement one embodiment of the flashlight of FIG. 11.

FIG. 20 is a circuit diagram 1200 which may be used to implement one embodiment of flashlight 1100 and sets forth further details regarding the operation of such an embodiment. Other circuits may be used in other embodiments. As shown in FIG. 20, washer 1170 operates as a switch which may cause power to be selectively provided to processor 1210, controller 1220, and other components set forth in circuit diagram 1200. As previously discussed, washer 1170 may provide such a switch by selectively contacting bushing 1138 and/or body 1136 in response to depression of push button 1191 and/or rotation of tailcap 1190 to various positions.

As also shown in FIG. 20, washer 1180 operates as a switch which may selectively bypass inductor 1168 (e.g., washer 1180 may selectively cause inductor 1168 to be in series between batteries 1150 and other components set forth in circuit diagram 1200). As previously discussed, washer 1180 may provide such a switch by selectively interrupting electrical contact between dimples 1185 of arms 1182 and end portions 1194 of conductor 1197 of PCB 1175 in response to depression of push button 1191 and/or rotation of tailcap 1190 to various positions.

In FIG. 20, washers 1170 and 1180 are both shown as open switches. However, it will be appreciated that the switches provided by washers 1170 and 1180 may open and close in response to manipulation of tailcap 1190 and push button 1191. In one embodiment, in the lockout mode of operation the switch provided by washer 1170 may be open and the switch provided by washer 1180 may be closed (e.g., washer 1170 may provide a normally open switch, and washer 1180 may provide a normally closed switch). The switch provided by washer 1170 may selectively close and the switch provided by washer 1180 may selectively open in response to various manipulations of tailcap 1190 and push button 1191 as discussed.

Circuit diagram 1200 also includes processor 1210 connected to light source 1115. In this regard, processor 1210 may selectively turn light source 1115 on and off and adjust the brightness level of light source 1115 in response to signals received from controller 1220.

Circuit diagram 1200 also includes controller 1220 with Hall effect sensors 1131 which, as previously discussed, may permit controller 1220 to detect the position of selector ring 1116 based on the interaction of magnet 1120 with Hall effect sensors 1131. In this regard, controller 1220 may receive appropriate signals from one or more of Hall effect sensors 1131 which controller 1220 may interpret to determine the position of selector ring 1116.

Controller 1220 may further detect the selective series insertion of inductor 1168 (e.g., in response to switching provided by washer 1180 to select between low beam and high beam brightness levels of light source 1115). In this regard, controller 1220 may receive appropriate signals to detect the switching of washer 1180 through a "SENSE" input shown in FIG. 20.

Controller 1220 may generate and provide one or more signals to processor 1210 in response to the detected position of selector ring 1116 and the detected series insertion of inductor 1168. In response to such signals, processor 1210 may control the operation of light source 1115 in accordance with the various modes discussed herein. Thus, it will be appreciated that the operation of tailcap 1190, push button 1191, and selector ring 1116 may cause controller 1220 to select various modes of operation for flashlight 1100 and cause processor 1210 to adjust the operation of light source 1115 accordingly (e.g., in accordance with the various operations discussed with regard to Tables 1 and 2, and/or other operations as may be desired in various embodiments).

Although various embodiments have been described herein with regard to flashlights, all aspects of the present disclosure may be applied to any type of lighting device where appropriate (e.g., flashlights, headlamps, weapon lights, and/or other lighting devices).

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa.

Software in accordance with the present disclosure, such as program code and/or data, can be stored on one or more machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:

a light source;

a controller adapted to provide one or more signals to control the operation of the light source;

a power terminal adapted to receive a power source; and a tailcap assembly comprising:

a tailcap, a push button, a first washer disposed in the tailcap, wherein the first washer comprises at least one arm adapted to be pushed against a surface to selectively connect the controller to the power terminal in response to a manipulation of the tailcap assembly, and a second washer disposed in the tailcap, wherein the second washer is adapted to selectively bypass a circuit component connected between the power terminal and the controller in response to a movement of the arm of the first washer as the arm of the first washer is pushed against the surface.

2. The lighting device of claim 1, wherein the manipulation comprises a depression of the push button.

3. The lighting device of claim 1, wherein the manipulation comprises a rotation of the tailcap.

4. The lighting device of claim 1, the tailcap assembly further comprising a circuit board disposed in the tailcap, wherein the arm of the first washer is adapted to push an arm of the second washer away from the circuit board to interrupt an electrical contact between the arm of the second washer and the circuit board to selectively bypass the circuit component.

5. The lighting device of claim 4, wherein the first and second washers are mounted on substantially opposite sides of the circuit board, wherein the arm of the first washer comprises a tab adapted to protrude through a recess in the circuit board to push against the arm of the second washer to interrupt the electrical contact as the arm of the first washer is pushed against the surface.

6. The lighting device of claim 4, wherein the interruption provided by the second washer causes the circuit component to be inserted in series with the power terminal.

7. The lighting device of claim 4, wherein the circuit component is an inductor.

8. The lighting device of claim 1, wherein the tailcap is adapted to rotate from a first position to a second position, wherein the first washer is closer to the surface in the second position than in the first position, wherein a depression of the push button while the tailcap is in the first position does not cause the first washer to contact the surface, wherein a depression of the push button while the tailcap is in the second position does cause the first washer to contact the surface.

9. The lighting device of claim 8, wherein the tailcap is adapted to rotate from the second position to a third position, wherein the first washer contacts the surface while the tailcap is in the third position.

10. The lighting device of claim 9, wherein the tailcap is adapted to rotate from the third position to a fourth position, wherein the first washer contacts the surface while the tailcap is in the fourth position, wherein the second washer is adapted to selectively bypass the circuit component while the tailcap is in the fourth position.

11. The lighting device of claim 1, further comprising:

a body; and a selector ring adapted to be rotated to a plurality of positions substantially about the body to adjust a mode of operation of the lighting device.

12. The lighting device of claim 11, further comprising:

a plurality of Hall effect sensors;

a magnet adapted to rotate with the selector ring; and wherein the controller is adapted to sense a position of the selector ring in response to interaction between the magnet and the Hall effect sensors and is adapted to provide the one or more signals in response to the sensed position of the selector ring.

13. The lighting device of claim 11, wherein the selector ring is adapted to prevent the light source from providing any light in response to any manipulation of the tailcap assembly while the selector ring is in an off position.

14. The lighting device of claim 11, wherein the tailcap assembly is adapted to prevent the light source from providing any light in response to any manipulation of the selector ring while the tailcap is in a lockout position.

15. The lighting device of claim 11, wherein the positions comprise:

a minimum brightness position to select a minimum brightness level of the light source;

a maximum brightness position to select a maximum brightness level of the light source;

one or more additional positions to select one or more intermediate brightness levels of the light source;

a strobe position to select a strobe pattern to flash the light source between the maximum brightness level and a substantially zero brightness level in accordance with the strobe pattern; and an SOS position to select an SOS pattern to flash the light source between the maximum brightness level and the substantially zero brightness level in accordance with the SOS pattern.

16. The lighting device of claim 11, wherein the controller is adapted to return the light source to a brightness level selected by the selector ring following a disconnection and reconnection of the controller to the power terminal by the first washer without requiring an adjustment of the selector ring.

17. The lighting device of claim 1, further comprising a body, wherein the surface is a surface of the body, wherein the first washer is adapted to selectively connect the controller to the power terminal through the body in response to the manipulation.

18. The lighting device of claim 17, wherein the surface of the body is a conductive bushing.

19. The lighting device of claim 1, wherein the light source is a light emitting diode (LED).

20. The lighting device of claim 1, wherein the lighting device is a flashlight.

21. A method of operating a lighting device comprising a light source, a controller, a power terminal, and a tailcap assembly comprising a tailcap and a first washer, a second washer, and a circuit board disposed in the tailcap, the method comprising:

receiving a manipulation of the tailcap assembly;

selectively connecting the controller to the power terminal in response to the manipulation, wherein the manipulation causes at least one arm of the first washer to be pushed against a surface;

providing one or more signals from the controller to control an operation of the light source in response to the connecting; and selectively bypassing a circuit component connected between the power terminal and the controller, wherein the selectively bypassing is performed by pushing an arm of the second washer away from the circuit board to interrupt an electrical contact between the arm of the second washer and the circuit board in response to a movement of the arm of the first washer as the arm of the first washer is pushed against the surface.

22. The method of claim 21, wherein the receiving a manipulation comprises receiving a depression of a push button of the tailcap assembly.

23. The method of claim 21, wherein the receiving a manipulation comprises receiving a rotation of the tailcap.

24. The method of claim 21, wherein the first and second washers are mounted on substantially opposite sides of the circuit board, wherein the arm of the first washer comprises a tab protruding through a recess in the circuit board, wherein the selectively bypassing further comprises pushing the tab of the arm of the first washer against the arm of the second washer to interrupt the electrical contact as the arm of the first washer is pushed against the surface.

25. The method of claim 21, wherein the interruption provided by the second washer causes the circuit component to be inserted in series with the power terminal.

26. The method of claim 21, wherein the circuit component is an inductor.

27. The method of claim 21, wherein the manipulation comprises rotating the tailcap from a first position to a second position, wherein the first washer is closer to the surface in the second position than in the first position, wherein a depression of a push button of the tailcap assembly while the tailcap is in the first position does not cause the first washer to contact the surface, wherein a depression of the push button while the tailcap is in the second position does cause the first washer to contact the surface.

28. The method of claim 27, further comprising rotating the tailcap from the second position to a third position, wherein the first washer contacts the surface while the tailcap is in the third position.

29. The method of claim 28, further comprising:

rotating the tailcap from the third position to a fourth position, wherein the first washer contacts the surface while the tailcap is in the fourth position; and using the second washer to selectively bypass the circuit component while the tailcap is in the fourth position.

30. The method of claim 21, wherein the lighting device further comprises a body, the method further comprising rotating a selector ring to a plurality of positions substantially about the body to adjust a mode of operation of the lighting device.

31. The method of claim 30, wherein the lighting device further comprises a plurality of Hall effect sensors and a magnet adapted to rotate with the selector ring, the method further comprising sensing a position of the selector ring in response to interaction between the magnet and the Hall effect sensors, wherein the providing one or more signals is performed further in response to the sensing.

32. The method of claim 30, further comprising preventing the light source from providing any light in response to any manipulation of the tailcap assembly while the selector ring is in an off position.

33. The method of claim 30, further comprising preventing the light source from providing any light in response to any manipulation of the selector ring while the tailcap is in a lockout position.

34. The method of claim 30, wherein the positions comprise:

a minimum brightness position to select a minimum brightness level of the light source;

a maximum brightness position to select a maximum brightness level of the light source;

one or more additional positions to select one or more intermediate brightness levels of the light source;

a strobe position to select a strobe pattern to flash the light source between the maximum brightness level and a substantially zero brightness level in accordance with the strobe pattern; and an SOS position to select an SOS pattern to flash the light source between the maximum brightness level and the substantially zero brightness level in accordance with the SOS pattern.

35. The method of claim 30, further comprising returning the light source to a brightness level selected by the selector ring following a disconnection and reconnection of the controller to the power terminal by the first washer without requiring an adjustment of the selector ring.

36. The method of claim 21, wherein the lighting device further comprises a body, wherein the surface is a surface of the body, wherein the selectively connecting comprises selectively connecting the controller to the power terminal through the body in response to the manipulation.

37. The method of claim 36, wherein the surface of the body is a conductive bushing.

38. The method of claim 21, wherein the light source is a light emitting diode (LED).

39. The method of claim 21, wherein the lighting device is a flashlight.

40. A lighting device comprising:

a light source;

a controller adapted to provide one or more signals to control the operation of the light source;

a power terminal adapted to receive a power source;

a tailcap assembly comprising:

a tailcap, a push button, a first washer disposed in the tailcap, wherein the first washer comprises at least one arm adapted to be pushed against a surface to selectively connect the controller to the power terminal in response to a manipulation of the tailcap assembly, and a second washer disposed in the tailcap;

wherein the tailcap is adapted to rotate from a first position to a second position, wherein the first washer is closer to the surface in the second position than in the first position, wherein a depression of the push button while the tailcap is in the first position does not cause the first washer to contact the surface, wherein a depression of the push button while the tailcap is in the second position does cause the first washer to contact the surface;

wherein the tailcap is adapted to rotate from the second position to a third position, wherein the first washer contacts the surface while the tailcap is in the third position; and wherein the tailcap is adapted to rotate from the third position to a fourth position, wherein the first washer contacts the surface while the tailcap is in the fourth position, wherein the second washer is adapted to selectively bypass a circuit component connected between the power terminal and the controller while the tailcap is in the fourth position.

41. A method of operating a lighting device comprising a light source, a controller, a power terminal, and a tailcap assembly comprising a push button, a tailcap, and a first washer, a second washer, and a circuit board disposed in the tailcap, the method comprising:

receiving a manipulation of the tailcap assembly;

selectively connecting the controller to the power terminal in response to the manipulation, wherein the manipulation causes at least one arm of the first washer to be pushed against a surface;

providing one or more signals from the controller to control an operation of the light source in response to the connecting;

wherein the manipulation comprises rotating the tailcap from a first position to a second position, wherein the first washer is closer to the surface in the second position than in the first position, wherein a depression of the push button while the tailcap is in the first position does not cause the first washer to contact the surface, wherein a depression of the push button while the tailcap is in the second position does cause the first washer to contact the surface;

rotating the tailcap from the second position to a third position, wherein the first washer contacts the surface while the tailcap is in the third position;

rotating the tailcap from the third position to a fourth position, wherein the first washer contacts the surface while the tailcap is in the fourth position; and using the second washer to selectively bypass a circuit component connected between the power terminal and the controller while the tailcap is in the fourth position.

* * * * *

UNITED STATES PATENT AND TRADEMARK OFFICE

CERTIFICATE OF CORRECTION

PATENT NO. : 8,096,674 B2
APPLICATION NO. : 12/775739
DATED : January 17, 2012
INVENTOR(S) : John W. Matthews et al.

It is certified that error appears in the above-identified patent and that said Letters Patent is hereby corrected as shown below:

In column 3, line 33, after "briefly", insert -- . --.

In column 10, line 44, change "1110" to -- 1100 --.

In column 10, line 46, change "1110" to -- 1100 --.

In column 10, line 47, change "1110" to -- 1100 --.

In column 10, line 52, change "1110" to -- 1100 --.

In column 10, line 54, change "1110" to -- 1100 --.

In column 13, line 25, change "1110" to -- 1100 --.

In column 15, line 7, change "1470" to -- 1170 --.

In column 16, line 10, change "1110" to -- 1100 --.

Signed and Sealed this
Tenth Day of April, 2012

David J. Kappos

David J. Kappos
*Director of the United States Patent and Trademark Office*